US009679524B2

(12) United States Patent
Xiao et al.

(10) Patent No.: US 9,679,524 B2
(45) Date of Patent: Jun. 13, 2017

(54) GATE DRIVING CIRCUIT

(71) Applicant: SHENZHEN CHINA STAR OPTOELECTRONICS TECHNOLOGY CO., LTD., Shenzhen (CN)

(72) Inventors: Juncheng Xiao, Shenzhen (CN); Chao Dai, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 33 days.

(21) Appl. No.: 14/416,397

(22) PCT Filed: Jun. 4, 2014

(86) PCT No.: PCT/CN2014/079156
§ 371 (c)(1),
(2) Date: Jan. 22, 2015

(87) PCT Pub. No.: WO2015/180198
PCT Pub. Date: Dec. 3, 2015

(65) Prior Publication Data

US 2015/0371599 A1 Dec. 24, 2015

(30) Foreign Application Priority Data

May 27, 2014 (CN) ..... 2014 1 0228218

(51) Int. Cl.
*G09G 3/36* (2006.01)
*G09G 3/20* (2006.01)

(52) U.S. Cl.
CPC ..... *G09G 3/36* (2013.01); *G09G 3/20* (2013.01); *G09G 2310/0267* (2013.01);
(Continued)

(58) Field of Classification Search
CPC .. G09G 3/3648; G09G 3/3677; G09G 3/3696; G09G 2310/08; G09G 2310/0286; G09G 2310/0205; G11C 19/28
See application file for complete search history.

(56) References Cited

U.S. PATENT DOCUMENTS 9,383,841 B2 * 7/2016 Lin ..... G06F 3/041
2010/0201668 A1 8/2010 Ko et al.
(Continued)

FOREIGN PATENT DOCUMENTS

CN 103208262 A 7/2013
CN 103559867 A 2/2014
(Continued)

OTHER PUBLICATIONS

Office Action issued on Sep. 21, 2015, by the State Intellectual Property Office of China in corresponding Chinese Patent Application No. 201410228218.2. (5 pages).
(Continued)

*Primary Examiner* — Christopher E Leiby
(74) *Attorney, Agent, or Firm* — Buchanan Ingersoll & Rooney PC

(57) ABSTRACT

The present invention relates to a gate driving circuit including a multiple of gate driving units. Each of the gate driving units comprises a pull-up control part, a pull-up part, a transfer part, a key pull-down part, a pull-down holding part and a boost part. In this case, the key pull-down part and the transfer part are configured, respectively, to pull potential on a gete signal output end down to and hold potentials on the control ends of the pull-up part and the transfer part at a potential of the first power supply or the second power supply, and also to pull potential on the output end of the transfer part ransfer signal down to and/or hold at a potential of the second power supply, wherein the potential of the
(Continued)

second power supply is lower than that of the first power supply.

17 Claims, 16 Drawing Sheets

(52) U.S. Cl.
CPC . *G09G 2310/0286* (2013.01); *G09G 2310/08* (2013.01); *G09G 2320/0219* (2013.01); *G09G 2330/04* (2013.01)

(56) References Cited

U.S. PATENT DOCUMENTS

| | | | | |
|---|---|---|---|---|
| 2010/0207928 | A1 | 8/2010 | Lee et al. | |
| 2012/0140871 | A1* | 6/2012 | Yang | G09G 3/20 377/79 |
| 2013/0181747 | A1 | 7/2013 | Yoon et al. | |
| 2014/0103983 | A1* | 4/2014 | Chang | G09G 3/3655 327/198 |
| 2014/0119493 | A1* | 5/2014 | Yang | G11C 19/28 377/64 |
| 2014/0355732 | A1* | 12/2014 | Lin | G06F 3/041 377/64 |
| 2015/0187302 | A1 | 7/2015 | Dai | |
| 2015/0279288 | A1 | 10/2015 | Dai et al. | |

FOREIGN PATENT DOCUMENTS

| | | | |
|---|---|---|---|
| CN | 103680453 | A | 3/2014 |
| CN | 103745700 | A | 4/2014 |
| CN | 103928009 | A | 7/2014 |
| JP | 2013-142899 | A | 7/2013 |

OTHER PUBLICATIONS

International Search Report (PCT/ISA/210) mailed on Nov. 28, 2014, by the Chinese Patent Office as the International Searching Authority for International Application No. PCT/CN2014/079156. (5 pages).

Written Opinion (PCT/ISA/237) mailed on Nov. 28, 2014, by the Chinese Patent Office as the International Searching Authority for International Application No. PCT/CN2014/079156. (7 pages).

* cited by examiner

GATE DRIVING CIRCUIT

The present application claims benefit of Chinese Patent Application No. 201410228218.2, filed in May 27, 2014 and entitled "Gate driving circuit", the disclosure of which is expressly incorporated by reference herein in its entirety.

FIELD OF THE INVENTION

The present disclosure relates to a liquid crystal display driving technology, in particular to a gate driving circuit of a liquid crystal display.

BACKGROUND OF THE INVENTION

Generally, a liquid crystal display device includes a plurality of pixel units, as well as a gate driving circuit (Gate IC) and a source driving circuit (Source IC) which are used for driving these pixel units. Wherein, the gate driving circuit consists of a plurality of cascaded gate driving units. These gate driving units sequentially output gate signals through gate lines coupled thereto to control corresponding switching transistors in a display area to be turned on row by row, so that data signals output by the source driving circuit are written into the corresponding pixel units, and thus corresponding image display is completed. Therefore, the working stability of the gate driving units has significant influence on accurate imaging of the display device. At present, the structures of gate driving circuit in thin film transistor liquid crystal display devices available on markets are roughly the same. Each gate driving unit includes a pull-up control part, a pull-up part, a transfer part, a key pull-down part, a pull-down holding part and a boost part.

FIG. 1 shows a schematic diagram of composition structure of an existing gate driving unit, wherein the gate driving unit includes:

a pull-up control part 100, which is configured to output a pull-up control signal (not shown in the figure);

a pull-up part 200, a control end of which (node Q (N) in the figure) coupled to an output end of the pull-up control part 100, and which is configured to pull up a potential of a gate signal output end (node G (N) in the figure) according to the pull-up control signal and a clock signal CK, so that the present gate driving unit outputs a gate signal G (N);

a transfer part 300, a control end of which (node Q (N) in the figure) coupled to the output end of the pull-up control part 100, and which is configured to output a transfer signal ST (N) according to the pull-up control signal and the clock signal CK;

a key pull-down part 400, which is coupled amonge the gate signal output end (node G (N) in the figure), the control ends (node Q (N) in the figure) of the pull-up part 200 and the transfer part 300, a first power supply VSS1 and a second power supply VSS2, and which is configured to pull down a potential of the gate signal output end and/or potentials of the control ends of the pull-up part and the transfer part to a potential of the first power supply or the second power supply, so as to switch off the gate signal output end and/or the pull-up part and the transfer part, according to a pull-down control signal;

a pull-down holding part 500, which is coupled amonge the gate signal output end (node G (N) in the figure), the control ends (node Q (N) in the figure) of the pull-up part 200 and the transfer part 300, the first power supply VSS1 and the second power supply VSS2, and which is configured to hold a potential of the gate signal output end and/or potentials of the control ends of the pull-up part and the transfer part to be a potential of the first power supply or the second power supply, according to a pull-down holding control signal;

a boost part 600, which is coupled with the control ends (node Q (N) in the figure) of the pull-up part 200 and the transfer part 300, and which is configured to ensure the present gate driving unit to accurately output a gate signal by raising the potentials of the control ends of the pull-up part and the transfer part.

In the above-mentioned gate driving circuit, the first power supply VSS1 and the second power supply VSS2 which are used for pulling down a node voltage are generally set with negative voltages and VSS2<VSS1<0, so as to prevent the pull-up part 200 and the pull-down holding part 500 from leak current which affects normal output of the gate driving unit. However, this is an ideal working state. Through long-term research and test, the inventor of the present disclosure discovers that a leak current path inevitably exists in the above-mentioned gate driving circuit due to a voltage difference between the first power supply VSS1 and the second power supply VSS2 in the gate driving circuit. In a serious case, a power supply chip for providing the first power supply VSS1 and the second power supply VSS2 could be burnt out as being in a working state of a negative voltage against a positive current, due to the leak current, for a long time, so that abnormal display of the liquid crystal display device is caused.

Further, as the voltage difference exists between the first power supply VSS1 and the second power supply VSS2, transistors which should have been turned off in the pull-down holding part 500 could be in a working state of positive bias, because a voltage between the gate and the source is greater than zero. That is, the transistors which should have been turned off can not be completely turned off, through which transistor the leak current flows. Such leak current is increased particularly during high-temperature operation state, and in a worse case, it causes the voltage holding function of the pull-down holding part 500 completely failure, so that the whole gate driving circuit is completely disabled.

On the other hand, the pull-down holding part 500 generally consists of two pull-down holding modules. These two pull-down holding modules, under the control of two clock signals of which the phases are complementary, generally work in an alternate manner. Due to lack of an effective discharge path, the gates of the transistors in the two pull-down holding modules are in a state of high potential for a long time due to accumulated charges. Likewise, the transistors are also in a turn-on working state for a long time, which leads to a worse stability. As a result, this will shorten the service life of the whole gate driving circuit.

In conclusion, how to reduce and even eliminate the leak current in the gate driving unit and improve the long-term working reliability and stability of the gate driving unit is a technical problem to be solved urgently in the liquid crystal display driving technology.

SUMMARY OF THE INVENTION

Aiming at the above-mentioned problem, the present disclosure proposes a gate driving circuit with low leak current and high reliability and stability.

A gate driving circuit including a multiple of gate driving units, wherein a $N^{th}$ gate driving unit comprises:

a pull-up control part, which is configured to output a pull-up control signal;

a pull-up part, a control end of which is coupled with an output end of the pull-up control part, and which is configured to pull up a potential of a gate signal output end according to the pull-up control signal and a clock signal, so that the $N^{th}$ gate driving unit outputs a gate signal;

a transfer part, a control end of which is coupled with the output end of the pull-up control part, and which is configured to output a transfer signal according to the pull-up control signal and the clock signal;

a key pull-down part, which is coupled among the gate signal output end, the control ends of the pull-up part and the transfer part, a first power supply and a second power supply to pull down, according to a pull-down control signal, a potential of the gate signal output end and/or potentials of the control ends of the pull-up part and the transfer part to a potential of the first power supply or the second power supply, so as to turn off the gate signal output end and/or turn off the pull-up part and the transfer part; and a pull-down holding part, which is coupled among the gate signal output end, the control ends of the pull-up part and the transfer part, the first power supply and the second power supply to hold, according to a pull-down holding control signal, a potential of the gate signal output end and/or potentials of the control ends of the pull-up part and the transfer part at a potential of the first power supply or the second power supply;

wherein, the key pull-down part and/or the pull-down holding part are further coupled between the output end of the transfer part and the second power supply, so as to pull the transfer signal down to and/or hold the transfer signal at a potential of the second power supply, wherein the potential of the second power supply is lower than that of the first power supply.

According to an embodiment of the present disclosure, the first power supply and the second power supply both are negative voltage sources.

According to an embodiment of the present disclosure, the pull-down holding part includes a first pull-down holding module and a second pull-down holding module which modules work in an alternate manner, and each pull-down holding module includes:

a control sub-module, which is configured to output the pull-down holding control signal;

a first pull-down transistor, the gate of which is coupled with an output end of the control sub-module to receive the pull-down holding control signal, a first end of which is coupled with the gate signal output end, and a second end of which is coupled to the first power supply or the second power supply;

a second pull-down transistor, the gate of which is coupled with the output end of the control sub-module to receive the pull-down holding control signal, a first end of which is coupled with the output end of the pull-up control part, and a second end of which is coupled to the first power supply or the second power supply; and a third pull-down transistor, the gate of which is coupled with the output end of the control sub-module to receive the pull-down holding control signal, and a first end and a second end of which are coupled, respectively, with the output end of the transfer part and to the second power supply.

According to one embodiment of the present disclosure, the above-mentioned control sub-module includes:

a first transistor, the gate of which is in short connection with its first end, and a second end of which is coupled with the output end of the control sub-module;

a second transistor, a first end and a second end of which are coupled, respectively, with the first end of the first transistor and the output end of the control sub-module;

a third transistor, the gate of which receives a transfer signal output by a $(N-1)^{th}$ gate driving unit, and a first end and a second end of which are coupled, respectively, with the output end of the control sub-module and to the second power supply; and a fourth transistor, the gate of which receives a transfer signal output by the $N^{th}$ gate driving unit, and a first end and a second end of which are coupled, respectively, with the output end of the control sub-module and to the second power supply;

wherein the gate of the first transistor in the first pull-down holding module and the gate of the second transistor in the second pull-down holding module both receive a first control signal, and the gate of the second transistor in the first pull-down holding module and the gate of the first transistor in the second pull-down holding module both receive a second control signal, wherein the first control signal and the second control signal are pulse signals of which the phases are complementary.

According to another embodiment of the present disclosure, the above-mentioned control sub-module includes:

a first transistor, the gate of which is in short connected with its first end, and a second end of which is coupled with the output end of the control sub-module;

a second transistor, the gate of which is coupled with the output end of the control sub-module, and a first end and a second end of which are coupled, respectively, with the first end of the first transistor and the output end of the control sub-module;

a third transistor, the gate of which receives a transfer signal output by a $(N-1)^{th}$ gate driving unit, and a first end and a second end of which are coupled, respectively, with the output end of the control sub-module and to the second power supply; and a fourth transistor, the gate of which receives a transfer signal output by the $N^{th}$ gate driving unit, and a first end and a second end of which are coupled, respectively, with the output end of the control sub-module and to the second power supply;

wherein, the gate of the first transistor in the first pull-down holding module receives a first control signal, and the gate of the first transistor in the second pull-down holding module receives a second control signal, wherein the first control signal and the second control signal are pulse signals of which the phases are complementary.

In the above-mentioned embodiment, the first control signal may be the clock signal.

In the above-mentioned embodiment, the first control signal may be a low-frequency pulse signal.

Further, when a $(N+2)^{th}$ gate driving unit outputs a gate signal of high level, the first control signal is overturned.

According to one embodiment of the present disclosure, the above-mentioned key pull-down part may pull down potential of the gate signal output end to the potential of the first power supply, and pull down potentials of the control ends of the pull-up part and the transfer part to the potential of the second power supply; and the pull-down holding part holds the potential of the gate signal output end at the potential of the first power supply, and holds the potentials of the control ends of the pull-up part and the transfer part at the potential of the second power supply.

According to another embodiment of the present disclosure, the above-mentioned key pull-down part pulls down potential of the gate signal output end and potentials of the control ends of the pull-up part and the transfer part to the potential of the first power supply; and the pull-down holding part holds the potential of the gate signal output end and the potentials of the control ends of the pull-up part and the transfer part at the potential of the first power supply.

According to one embodiment of the present disclosure, the above-mentioned key pull-down part may include:

a first transistor, the gate of which receives a pull-down control signal, and a first end and a second end of which are coupled, respectively, with the output end of the pull-up control part and to the first power supply; and a second transistor, the gate of which receives the pull-down control signal, and a first end and a second end of which are coupled, respectively, with the gate signal output end and to the first power supply;

wherein the pull-down control signal is a gate signal output by the $(N+1)^{th}$ gate driving unit or by the $(N+2)^{th}$ gate driving unit.

According to one embodiment of the present disclosure, the above-mentioned key pull-down part may include:

a first transistor, the gate of which receives a pull-down control signal, and a first end and a second end of which are coupled, respectively, with the output end of the pull-up control part and to the first power supply;

wherein the pull-down control signal is a gate signal output by the $(N+2)^{th}$ gate driving unit.

According to another embodiment of the present disclosure, the above-mentioned key pull-down part may include:

a first transistor, the gate of which receives the pull-down control signal, and a first end and a second end of which are coupled, respectively, with the output end of the pull-up control part and to the first power supply;

a second transistor, the gate of which receives the pull-down control signal, and a first end and a second end of which are coupled, respectively, with the gate signal output end and to the first power supply; and a third transistor, the gate of which receives the pull-down control signal, and a first end and a second end of which are coupled, respectively, with the output end of the transfer part and to the second power supply;

wherein the pull-down control signal is a gate signal output by the $(N+1)^{th}$ gate driving unit.

According to a further embodiment of the present disclosure, the above-mentioned key pull-down part may include:

a first transistor, the gate of which receives a first pull-down control signal, and a first end and a second end of which are coupled, respectively, with the output end of the pull-up control part and to the first power supply; and a second transistor, the gate of which receives a second pull-down control signal, and a first end and a second end of which are coupled, respectively, with the output end of the transfer part and to the second power supply;

wherein the first pull-down control signal is a gate signal output by the $(N+2)^{th}$ gate driving unit, and the second pull-down control signal is a gate signal output by the $(N+1)^{th}$ gate driving unit.

Further, in the other embodiment, the above-mentioned key pull-down part may further include a third transistor, wherein the gate thereof receives the second pull-down control signal, and a first end and a second end thereof are coupled, respectively, with the gate signal output end and to the first power supply.

Further, in the above-mentioned multiple embodiments, the key pull-down part may further include:

a choking transistor, the gate of which is in short connection with its first end, and the first end and a second end of which are coupled, respectively, with the second end of the first transistor and to the second power supply.

Moreover, in the key pull-down part, a channel width of the choking transistor is preferably set as 5-10 times of that of the first transistor.

In the above-mentioned multiple embodiments, the pull-up control signal may be a gate signal output by the $(N-1)^{th}$ gate driving unit.

Compared with an existing gate driving circuit, the present disclosure has the following advantages.

1. The design of two negative voltage sources is reserved in the present disclosure, wherein VSS2<VSS1, VSS2 is used for pulling down potentials of a node P (N), a node K (N) and a node ST (N), and VSS1 is used for pulling down potentials of a node Q (N) and a node G (N). In this way, on the one hand, the potentials of the nodes P (N) and K (N) can be reduced while the potentials of the nodes G (N) and Q (N) are pulled up, so that leak current flowing through the pull-down transistors in the pull-down holding part can be reduced. On the other hand, the potential of the node ST (N) can be pulled down, by means of two newly added transistors T71 and T72, to a potential of VSS2 while the potentials of the node G (N) and the node Q (N) are pulled down, so that the potentials of the nodes P (N) and K (N) can be better held at high potentials. Accordingly, abnormal operation is avoided in the pull-down holding part and even in the whole gate driving unit.

2. In the present disclosure, transistors T54 and T64 are newly added into the pull-down holding part to form discharge paths for the node P (N) and the node K (N) respectively. In this way, the potentials of the nodes P (N) and K (N) can be changed along with the level of the control signal, so as to shorten the turn-on time of the pull-down transistors, and thereby the working stability of the pull-down holding part and even of the whole gate driving unit can be enhanced to a certain extent.

3. In the present disclosure, the second ends of the pull-down transistors T42 and T43 in the pull-down holding part are coupled to VSS2, so that a leak current loop in the gate driving circuit can be effectively eliminated.

4. In the present disclosure, a transistor T73 is newly added into the key pull-down part to form a discharge path for the node ST (N) by mean of which the potential of the node ST (N) is quickly pulled down to a low potential, so that the rising speed of the potentials of the nodes P (N) and K (N) is improved. Further, when a delay time for decline of potential of the node ST (N) is shorter than that of the node G (N), it is possible for the pull-up control part to prevented the potential of Q (N+1) from leaking off, so that the risk of errors in the gate driving circuit is dismissed, and thus the long-term working reliability of the gate driving circuit is enhanced.

5. In order to solve the problem of leak current loop between the negative voltage sources, a chocking transistor T44 is newly added into the key pull-down part to prevent the leak current from flowing back to VSS1 from VSS2, so that the leak current loop in the gate driving circuit can be effectively eliminated.

6. In the present disclosure, the control signal for controlling the two pull-down holding modules to work in an alternate manner in the pull-down holding part is configured to be a low-frequency pulse signal, so that the power loss of the whole gate driving circuit can be effectively reduced.

Other features and advantages of the present disclosure will be set forth in the following description, and are partially obvious from the description or understood by implementing the present disclosure. The objectives and other advantages of the present disclosure may be achieved and obtained by structures particularly pointed out in the description, the claims and the accompanying drawings.

BRIEF DESCRIPTION OF THE DRAWINGS

The accompanying drawings are configured to provide a further understanding of the present disclosure, and constitute a part of the description for explaining the present disclosure together with the embodiments without limiting the present disclosure. In the accompanying drawings.

DETAILED DESCRIPTION OF THE EMBODIMENTS

In order to make the technical contents disclosed by the present disclosure more detailed and complete, the composition structure and operation principle of an existing gate driving unit and the technical problem to be solved urgently thereof will be first illustrated in detail below with reference to the accompanying drawings.

Figure 1:
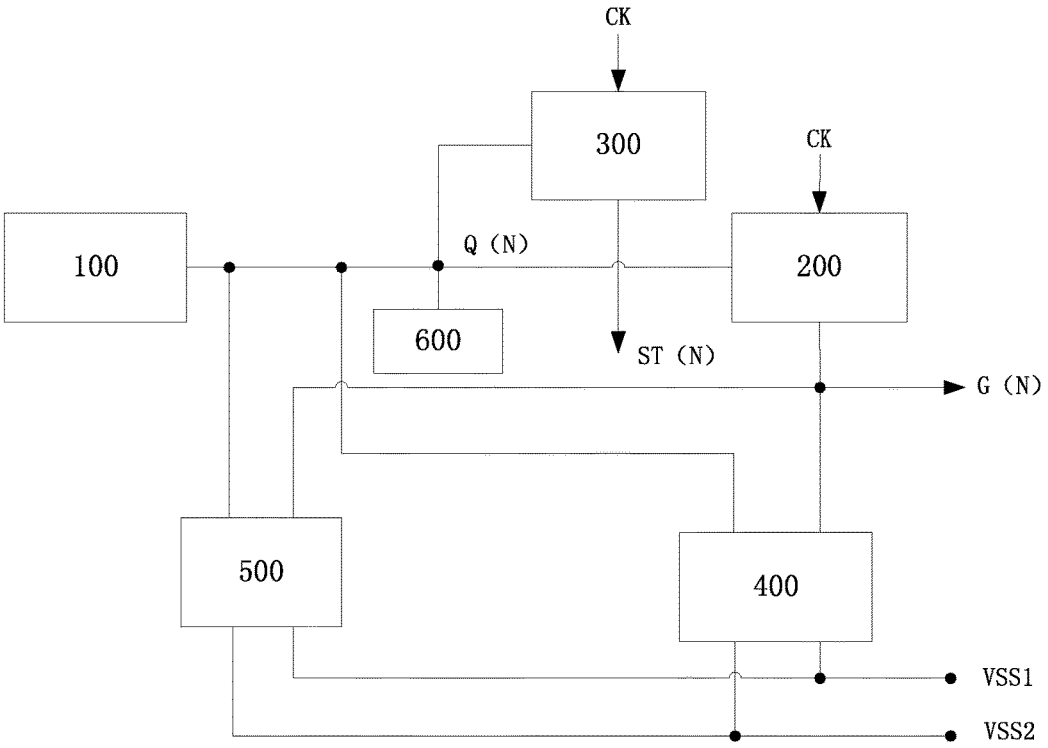
FIG. 1 is a schematic diagram of functional module composition of an existing gate driving unit.
Figure 2A:
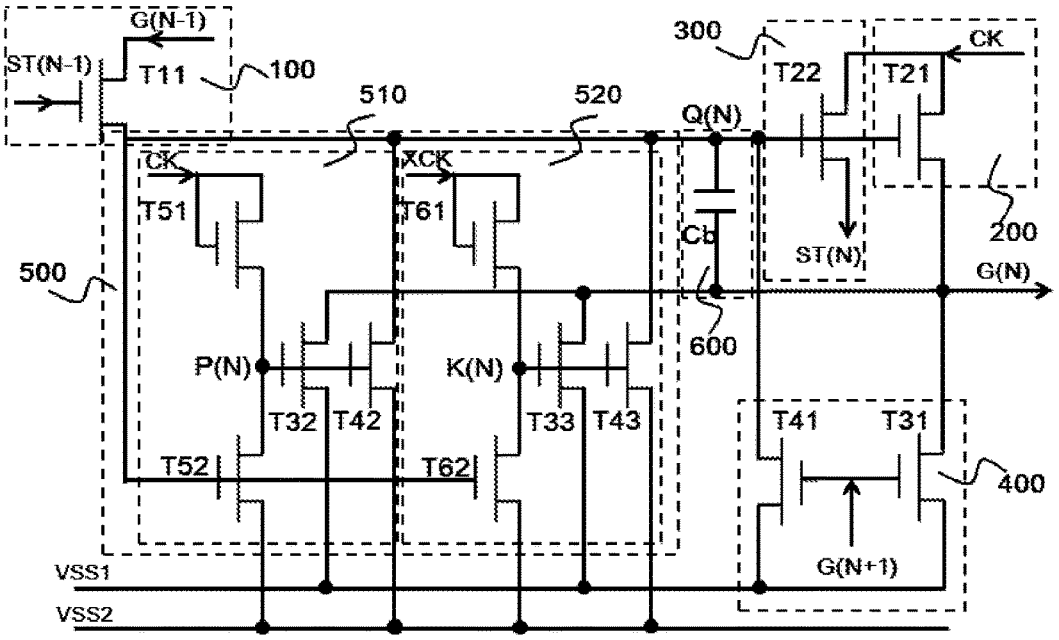
FIG. 2A is a schematic diagram of circuit structure of an existing gate driving unit.

FIG. 2A shows a schematic diagram of circuit structure of a gate driving unit disclosed in a Chinese patent application No. 103559867A. This figure only shows a gate driving unit which is denoted as N. For convenience of illustration, a previous one of this gate driving unit is denoted as N−1, and the one after this gate driving unit is marked as N+1, and so on.

Figure 2B:
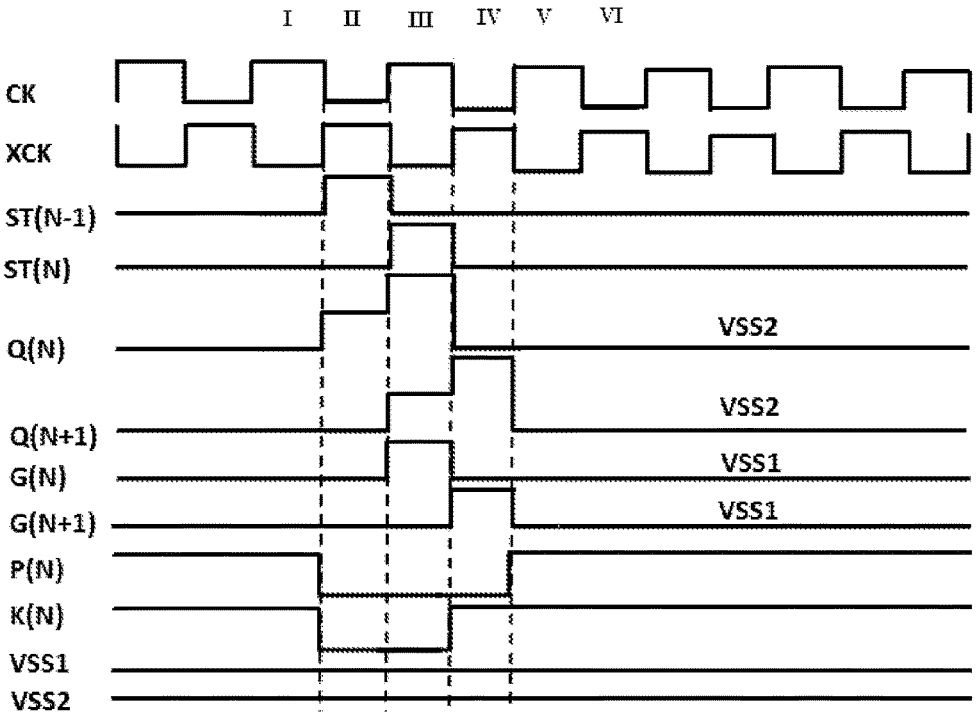
FIG. 2B is a time sequence diagram of signals in the gate driving unit of FIG. 2A.

The composition structure and operation principle of a $N^{th}$ gate driving unit will be illustrated in detail below in combination with a signal time sequence diagram shown in FIG. 2B.

A pull-up control part 100 includes a transistor T11. The gate of the transistor T11 receives a transfer signal ST (N−1) output by a $(N-1)^{th}$ gate driving unit. Under the action of the transfer signal ST (N−1), the transistor T11 outputs a gate signal G (N−1) transmitted from the $(N-1)^{th}$ gate driving unit. Said gate signal G (N−1) is the pull-up control signal mentioned above.

A pull-up part 200 includes a transistor T21. The gate of the transistor T21 is coupled to an output end (node Q (N) in the figure) of the pull-up control part 100 to receive a gate signal G (N−1) output by the pull-up control part 100. Under the action of the gate signal G (N−1), the transistor T21 pulls up the potential of a gate signal output end (node G (N) in the figure) according to a first clock signal CK, namely it controls the present gate driving unit to output a gate signal G (N).

A transfer part 300 includes a transistor T22. The gate of the transistor T22 is coupled to the output end (node Q (N) in the figure) of the pull-up control part 100 to receive the gate signal G (N−1) output by the pull-up control part 100. Under the action of the gate signal G (N−1), the transistor T22 outputs a transfer signal ST (N) according to the first clock signal CK.

A key pull-down part 400 includes transistors T31 and T41. The gates of the transistors T31 and T41 both receive a gate signal G (N+1) output by a $(N+1)^{th}$ gate driving unit. Said gate signal G (N+1) is the pull-down control signal mentioned above. The source and drain of the transistor T31 are coupled, respectively, to the gate signal output end (node G (N) in the figure) and a first power supply VSS1. The source and drain of the transistor T41 are coupled, respectively, to the output end (node Q (N) in the figure) of the pull-up control part 100 and the first power supply VSS1.

A pull-down holding part 500 generally includes two pull-down holding modules 510 and 520 which two work in a alternat manner. The pull-down holding module 510, taken as an example, includes transistors T32, T42, T51 and T52. In this case, the transistors T51 and T52 constitute a control sub-module, which control sub-module outputs a pull-down holding control signal (not denoted in the figure) at a node P (N). The gates of the transistors T32 and T42 both are coupled with the node P (N), so as to receive the pull-down holding control signal output by the control sub-module. The source and drain of the transistor T32 are coupled, respectively, to the gate signal output end (node G (N) in the figure) and the first power supply VSS1. The source and drain of the transistor T42 are coupled to the output end (node Q (N) in the figure) of the pull-up control part 100 and a second power supply VSS2 respectively. In the control sub-module, the gate of the transistor T51 is in short connection with its source to receive the first clock signal CK, and the drain of the transistor T51 is coupled with the node P (N). The gate of the transistor T52 is coupled to the output end (node Q (N) in the figure) of the pull-up control part 100, and the source and drain of the transistor T52 are coupled, respectively, to the node P (N) and the second power supply VSS2. Similar to the pull-down holding module 510, the pull-down holding module 520 includes transistors T33, T43, T61 and T62, but the transistor T61 instead receives a second clock signal XCK of which the phase is opposite to that of the first clock signal CK.

A boost part 600 includes a storage capacitor Cb. The upper and lower electrodes of the storage capacitor Cb are coupled to the output end (node Q (N) in the figure) of the pull-up control part 100 and the gate signal output end (node G (N) in the figure) respectively. The storage capacitor Cb raises up the potential of the node Q (N) once again by means of charging, so as to ensure that the present gate driving unit may output the gate signal G (N) as normally.

It should be noted that, in the above-mentioned gate driving circuit, to prevent the pull-up part 200 and the pull-down holding part 500 from leak current which affects normal output of the gate signal G (N), the first power supply VSS1 and the second power supply VSS2 are generally configured to be negative voltage sources, and wherein VSS2<VSS1<0. However, through a long-term research and test, the inventor of the present disclosure discovers that the technical effect actually achieved in this way is very limited. Because a voltage difference exists between the first power supply VSS1 and the second power supply VSS2, leak current loops L100 and L200 shown in FIG. 2C has been existing in said gate driving circuit for all the time:

L100 is a leak current loop which is from the first power supply VSS1 to the second power supply VSS2 through the transistors T41 (N) and T43 (N) in the present gate driving unit; and L200 is a leak current loop which is from the first power supply VSS1 to the second power supply VSS2 through the transistor T31 (N−1) of the $(N-1)^{th}$ gate driving unit, the transistors T11 (N) and T42 (N) in the present gate driving unit.

In the above-mentioned two leak current loops L100 and L200, the magnitude of leak current is closely related to potentials of the nodes P (N) and K (N) in the present gate driving unit, and it is in direct proportion to the number of gate driving units included in the whole gate driving circuit. This means that, with increase of size of a display panel, the leak current is increased, and burden of the first power supply VSS1 and the second power supply VSS2 is also increased accordingly. In a serious case, a power supply chip for providing the first power supply and the second power supply is burnt out as being in a working state of negative voltage against positive current for a long time, so that abnormal display of a liquid crystal display device is caused.

Further, in the above-mentioned gate driving unit, the pull-down holding part 500 also has the following problems.

1) In the pull-down holding modules 510 and 520, the gate of the transistor T52 is coupled with the node Q (N), and the drain and source of the transistor T52 are coupled with the node P (N) and the second power supply VSS2 respectively. The gate of the transistor T62 is coupled with the node Q (N), and the drain and source of the transistor T62 are coupled, respectively, with the node K (N) and the second power supply VSS2. Generally, during a non-acting time, a potential of the node Q (N) is held at about −6V, and a potential of the second power supply VSS2 is always lower than that of the node Q (N). Therefore, for the transistors T52 and T62, voltage Vgs between the gate and source of both transistors are greater than zero. Then, the transistors T52 and T62 work in a state of positive bias, and a certain degree of leak current Igs flows through the transistors T52 and T62. In other words, the transistors T52 and T62 can not be completely turned off, so that the potentials of the node P (N) and the node K (N) are attenuated. This phenomenon may be very serious particularly during high-temperature operation state, in which the pull-down function of the pull-down holding modules 510 and 520 are caused to be failure, and thereby the operation of the whole gate driving circuit is abnormal.

Figure 2C:
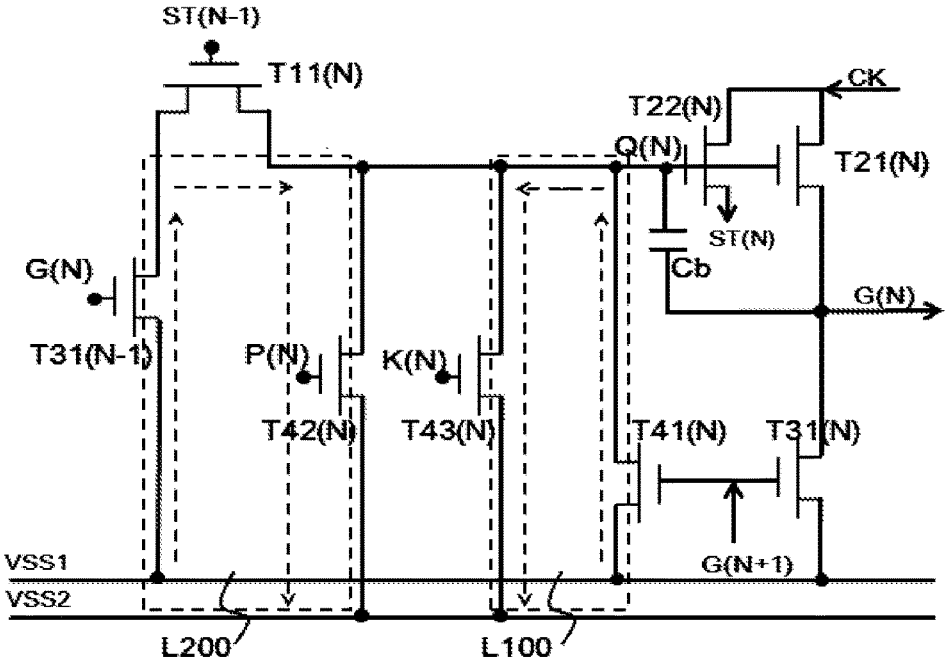
FIG. 2C is a schematic diagram of a leak current loop in the gate driving unit of FIG. 2A.

2) In the pull-down holding modules 510 and 520, the transistors T51 and T61 are both equivalent to diodes. Taking the pull-down holding module 510 as an example, in the non-acting time, when the first clock signal CK is of high level, the transistor T51 is turned on and the node P (N) accumulates charges, and when the first clock signal CK is of low level, the transistor T51 is turned off. Due to lack of an effective discharge path, the potential of the node P (N) is held at a high level for a long time (as shown in FIG. 2C). As a result, the transistors T32 and T42 operate in a turn-on state for a long time, which cause a worse stability. Similarly, in the pull-down holding module 520, the stabilities of the transistors T33 and T43 also get worse. This may shorten the service life of the whole gate driving circuit.

Aiming at the above-mentioned problems, an improvement for the structure of the above-mentioned gate driving unit is provided in the present disclosure. It should be specially explained that, although the technical solutions of the present disclosure will be illustrated below with reference to the accompanying drawings and embodiments, those skilled in the art should understand that the accompanying drawings and the embodiments are not intent to limit the scope of the present disclosure.

Figure 3A:
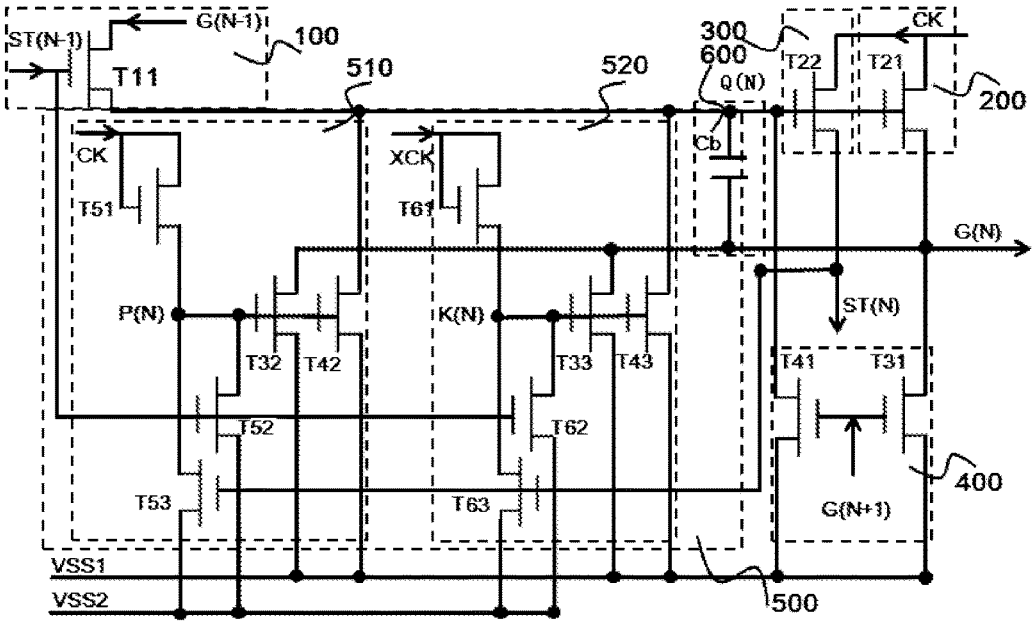
FIG. 3A is a schematic diagram of circuit structure of a gate driving unit according to embodiment I of the present disclosure.

FIG. 3A shows a schematic diagram of circuit structure of a gate driving unit according to embodiment I of the present disclosure. An improvement for this circuit is made to the pull-down holding part 500 on the basis of the gate driving unit shown in FIG. 2A. Similarly, the improved pull-down holding part 500 includes two pull-down holding modules 510 and 520, wherein the first pull-down holding module 510 includes transistors T32, T42, T51, T52 and T53, and the second pull-down holding module 520 includes transistors T33, T43, T61, T62 and T63.

The gates of the transistors T32 and T33 are coupled, respectively, with the node P (N) and the node K (N), while the sources of both transistors T32 and T33 are coupled with the node G (N), and the drains thereof are both coupled to the first power supply VSS1. The transistors T32 and T33 are configured to hold the potential of the node G (N) to be a potential of the first power supply VSS1 during the non-acting time.

The gates of the transistors T42 and T43 are coupled, respectively, with the node P (N) and the node K (N), while the sources of both transistors T42 and T43 are coupled with the node Q (N), and the drains thereof are both coupled to the first power supply VSS1. The transistors T32 and T33 are configured to hold the potential of the node Q (N) to be a potential of the first power supply VSS1 in the non-acting time.

The gates of the transistors T51 and T61 are respectively in short connection with their respective sources, so as to receive the first clock signal CK and the second clock signal XCK respectively, and the drains of the transistors T51 and T61 are coupled, respectively, with the node P (N) and the node K (N). The transistors T51 and T61 transmit the first clock signal CK and the second clock signal XCK, which two signals are of high level, to the node P (N) and the node K (N) respectively.

The gates of the transistors T52 and T62 are both coupled with the transfer signal ST (N−1) output by the $(N-1)^{th}$ gate driving unit, while the sources of the transistors T52 and T62 are coupled with the node P (N) and the node K (N) respectively, and the drains of the transistors T52 and T62 are both coupled to the second power supply VSS2. The transistors T52 and T62 are configured to, when the potential of the node ST (N−1) is high, pull down the potentials of the nodes P (N) and K (N) to a potential of the second power supply VSS2 respectively, namely turning off the pull-down holding part 500, so as to prevent the pull-down holding part 500 from affecting the normal output of the gate driving unit.

The gates of the transistors T53 and T63 are both coupled with ST (N), while the sources of the transistors T53 and T63 are coupled, respectively, with the node P (N) and the node K (N), and the drains of the transistors T53 and T63 are both coupled to the second power supply VSS2. The transistors T53 and T63 are configured to, when the potential of the node ST (N) is high, pull down the potentials of the nodes P (N) and K (N) to the potential of the second power supply VSS2 respectively, namely turning off the pull-down holding part 500, so as to prevent the pull-down holding part 500 from affecting the normal output of the gate driving unit.

Figure 3B:
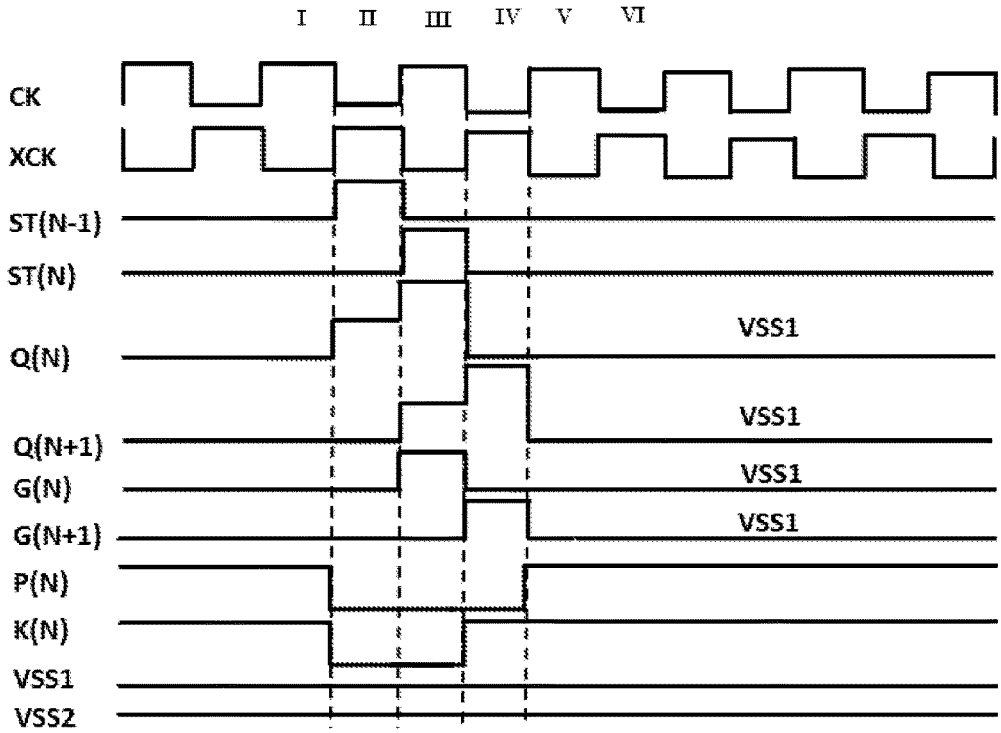
FIG. 3B is a time sequence diagram of signals in the gate driving unit of FIG. 3A.

FIG. 3B shows a time sequence diagram of signals in the gate driving unit shown in FIG. 3A, wherein the first clock signal CK and the second clock signal XCK are two serials of pulse signals of which two the phases are complementary.

During time period I: as the signal CK is of high level while the signal XCK is of low, the transistor T51 is turned on and T61 is turned off. As the node ST (N−1) is at a low level, the transistors T11, T52 and T62 are turned off. Then, as T11 is turned off, T21 and T22 are turned off accordingly, and the node ST (N) is of low level. Because the node ST (N) is low, T53 and T63 are both turned off. As T51 is turned on and the signal CK is of high level, the node P (N) is at a high potential as the same as the signal CK. With T61, T62 and T63 being turned off, the node K (N) still keeps a high potential because the signal XCK is of high level in the previous one time period (due to lack of a discharge path). Accordingly, since the node P (N) and the node K (N) are of high level, the transistor T32 and T42 are both turned on, and T33 and T43 are turned on, such that the potentials of the nodes Q (N) and G (N) are both pulled down to a potential of the first power supply VSS1.

During time period II: as the signal CK is of low level while the signal XCK is of high, the transistor T51 is turned off and T61 is turned on. As the node ST (N−1) is of high, T11, T52 and T62 are all turned on. Then, since the T11 is turned on and the gate signal G (N−1) output by the $(N-1)^{th}$ gate driving unit is of high level, the capacitance Cb is charged to a first potential under the action of the G (N−1), namely rasing up the potential of the node Q (N) to the first potential, and at the meanwhile, the transistors T21 and T22 are turned on. Because the T22 is turned on and CK is low, the node ST (N) is of low level. As the node ST (N) is at a low potential, T53 and T63 are both turned off. However, since T52 and T62 are turned on, the potentials of the nodes P (N) and K (N) are pulled down to a potential of the second power supply VSS2, such that T32 and T42 are turned off, and T33 and T43 are turned off. Since T21 is turned on but CK is low, the node G (N) is held at a low potential.

During time period III: as the signal CK is of high level while the signal XCK is of low, the transistor T51 is turned on and T61 is turned off. As the node ST (N−1) is of low level, T11, T52 and T62 are all turned off. Then, due to energy storage effect of the capacitance Cb, the gate of T21 and T22 are still held at high potentials, and T21 and T22 are kept turn-on. Because T22 is turned on and CK is high, the node ST (N) is at a high potential as the same as the signal CK. Then, since the node ST (N) is at a high level, T53 and T63 are thus turned on, so that the potentials of the nodes P (N) and K (N) are still held at a potential of the second power supply VSS2. As a result, T32 and T42 are both turned off, and T33 and T43 are both turned off. Further, since the transistor T21 is turned on and the signal CK is high, Cb is recharged, under the action of CK, to a second potential higher than the first potential. That is, the potential of the node Q (N) is raised up to the second potential which is higher than the first potential. Because, the node G (N+1) is of low level, T31 and T41 are turned off. However, because T21 is turned on and CK is of high level, the node G (N) is thereby at a high potential as the same as the signal CK.

During time period IV: as the signal CK is of low level while the signal XCK is of high, the transistor T51 is turned off and T61 is turned on. As the node ST (N−1) is of low level, T11, T52 and T62 are all turned off. Then, because the gate signal G (N+1) output by the $(N+1)^{th}$ gate driving unit is high, the transistors T31 and T41 are both turned on, so that the potentials of the nodes Q (N) and G (N) are both pulled down to a potential of the first power supply VSS1. Then, since the node Q (N) is of low level (VSS1 is a negative voltage), T21 and T22 are turned off, and the node ST (N) is at a low potential. Because the node ST (N) is low, T53 and T63 then are turned off. Accordingly, since T51, T52 and T53 are turned off, the node P (N) is still held at a low potential; and since T61 is turned on and the signal XCK is of high level, the node K (N) is at a high potential as the same as the signal XCK.

During time period V: as the signal CK is of high level while the signal XCK is of low, the transistor T51 is turned on and T61 is turned off. As the node ST (N−1) is low, T11, T52 and T62 are all turned off. Then, since T11 is turned off, the transistors T21 and T22 are turned off, and the node ST (N) is at a low potential. Then, because the node ST (N) is of low, T53 and T63 are both turned off. Since T51 is turned on and the signal CK is of high level, the node P (N) is at a high potential as the same as the signal CK. As T61, T62 and T63 are turned off, the node K (N) still keeps a high potential because the signal XCK in the previous one time period is high (due to lack of a discharge path). Accordingly, since the node P (N) and the node K (N) are both of high, T32 and T42 are turned on, and T33 and T43 are turned on, so that the potentials of the nodes Q (N) and G (N) are still held at a potential of the first power supply VSS1.

During time period VI: as the signal CK is of low level while the signal XCK is high, the transistor T51 is turned off and T61 is turned on. As the node ST (N−1) is of low level, T11, T52 and T62 are all turned off. Then, since T11 is turned off, the transistors T21 and T22 are both turned off, and the node ST (N) is at a low potential. Because the node ST (N) is of low level, T53 and T63 are turned off. Then, as T51, T52 and T53 are turned off, the node P (N) still keeps a high potential because the signal XCK is high in the previous one time period (due to lack of a discharge path). Since T61 is turned on and the signal XCK is of high level, the node K (N) is at a high potential as the same as the signal CK. Accordingly, as the node P (N) and the node K (N) are both of high level, the transistors T32 and T42 are turned on, and T33 and T43 are also turned on, so that the potentials of the nodes Q (N) and G (N) are still held at a potential of the first power supply VSS1.

Thereafter, as long as no new high level transfer signal ST (N−1) arrives, the above-mentioned gate driving unit is switched forth and back between the working states of the time period V and the time period VI.

It could be seen from the above analysis on the signal time sequence that, since the drains of the transistors T42 and T43 are coupled to the first power supply VSS1, the leak current loops in the gate driving unit of FIG. 2A do not exist any more. The gate driving unit provided in the present disclosure realizes the original functions and, at the same time, effectively solves the problem of current leakage caused by the voltage difference between the two negative voltage sources.

Figure 4A:
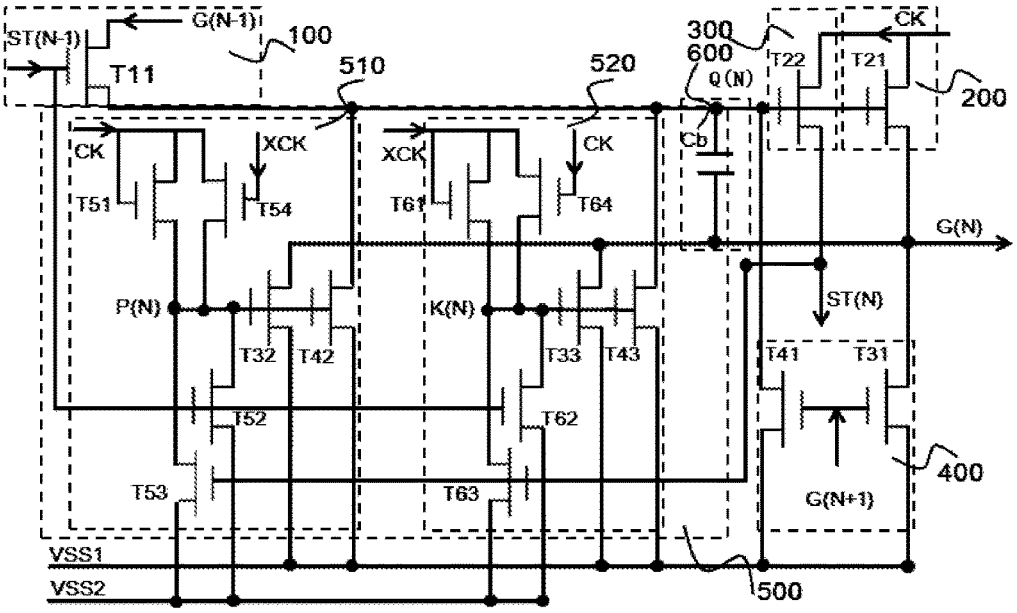
FIG. 4A is a schematic diagram of circuit structure of a gate driving unit according to embodiment II of the present disclosure.

FIG. 4A shows a schematic diagram of circuit structure of a gate driving unit according to embodiment II of the present disclosure. An improvement for this circuit is made to the pull-down holding part 500 on the basis of the gate driving unit shown in FIG. 3A. Specifically, transistors T54 and T64 are newly added into the circuit to constitute discharge paths for the node P (N) and the node K (N) respectively.

The gate of the transistor T54 is coupled with the second clock signal XCK, the source of which transistor is coupled with the source of the transistor T51, and the drain of which transistor is coupled with the node P (N). The transistor T54 is configured to quickly pull down the potential of the node P (N) to a low potential of the second clock signal XCK.

The gate of the transistor T64 is coupled with the first clock signal CK, the source of which transistor is coupled with the source of the transistor T61, and the drain of which transistor is coupled with the node K (N). The transistor T64 is configured to quickly pull down the potential of the node K (N) to a low potential of the first clock signal CK.

Figure 4B:
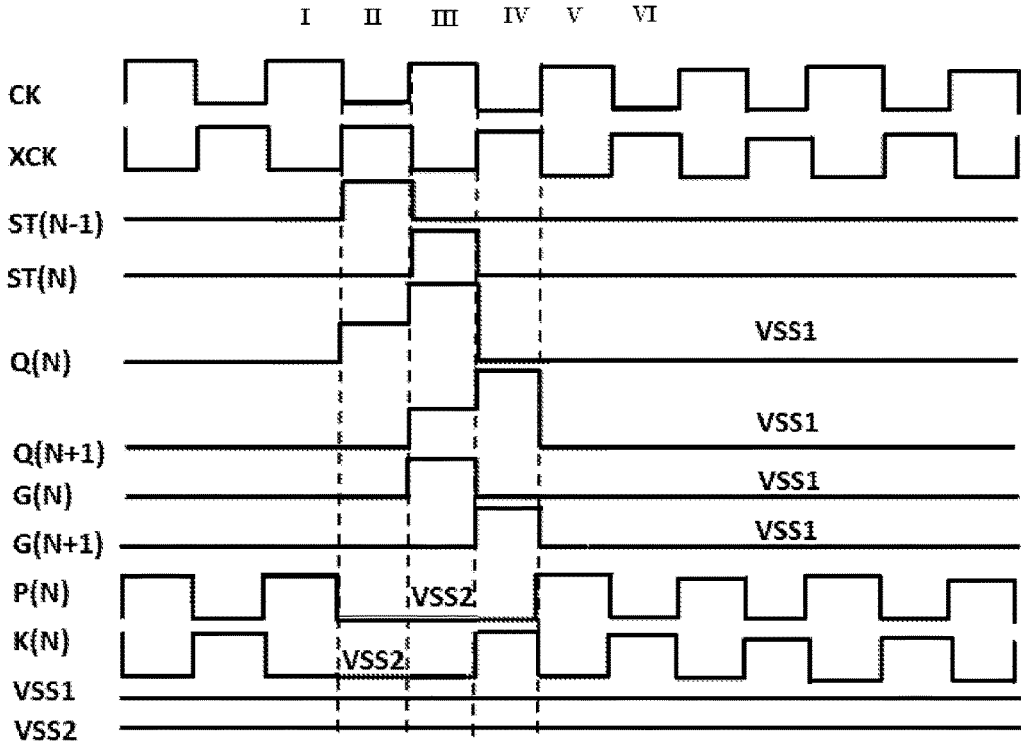
FIG. 4B is a time sequence diagram of signals in the gate driving unit of FIG. 4A.

FIG. 4B shows a time sequence diagram of signals in the gate driving unit shown in FIG. 4A. The operating principle of this circuit will be illustrated in detail below by taking time period V and time period VI as examples.

During the time period V: as the signal CK is of high level while the signal XCK is of low, the transistors T51 and T64 are turned on, and T54 and T61 are turned off. Then, since T51 is turned on and CK is of high level, the node P (N) is at a high potential as the same as the signal CK. Although T61 is turned off, T64 is turned on, so that the potential of the node K (N) is quickly pulled down to a low potential of the signal XCK by the transistor T64.

During the time period VI: as the signal CK is of low level while XCK is high, the transistors T51 and T64 are both turned off, and T54 and T61 are turned on. Then, since T51 is turned off but the T54 is turned on, the potential of the node P (N) is quickly pulled down to a low potential of the signal CK by means of the transistor T64. Accordingly, because T61 is turned on and the signal XCK is of high potential, the node K (N) is at a high potential as the same as the signal CK.

It could be seen from above analysis on the signal time sequence that, by introducing the transistors T54 and T64, the potentials of the nodes P (N) and K (N) can be changed along with changes of the first clock signal CK and the second clock signal XCK, so that the pull-down transistors may work in an intermittent manner, and thus the working stabilities of the pull-down holding part and even of the whole gate driving unit can be enhanced to a certain extent.

Figure 5A:
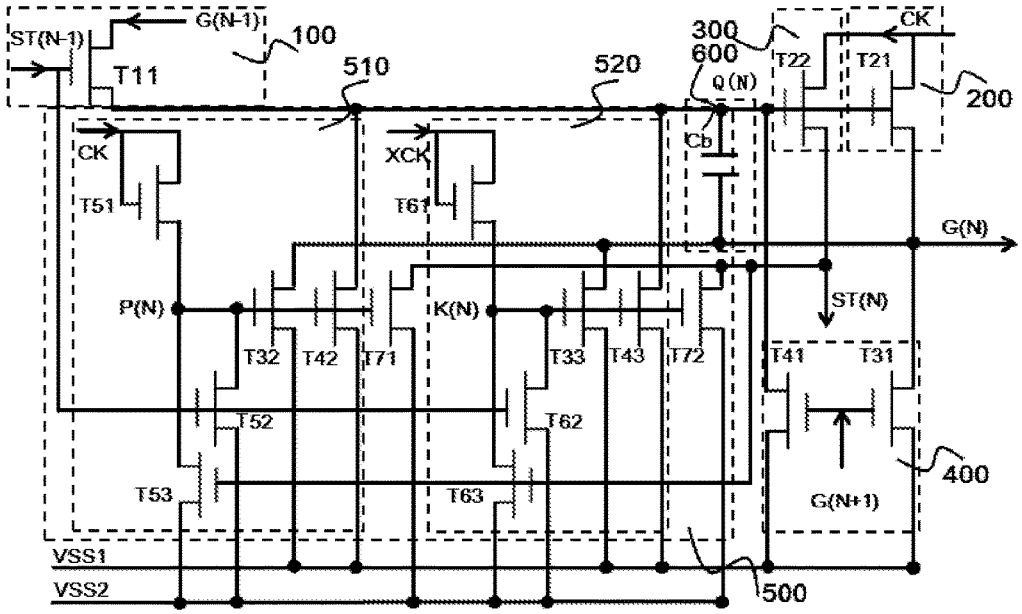
FIG. 5A is a schematic diagram of circuit structure of a gate driving unit according to embodiment III of the present disclosure.

FIG. 5A shows a schematic diagram of circuit structure of a gate driving unit according to embodiment III of the present disclosure. Another improvement for this circuit is made to its pull-down holding part 500 on the basis of the gate driving unit shown in FIG. 3A. Specifically, two transistors T71 and T72 are newly added into the circuit to pull down the potential of the node ST (N) to a potential of the second power supply VSS2. In this case, the gate of the transistors T71 and T72 are coupled with the node P (N) and the node K (N) respectively, the source of the transistors T71 and T72 are both coupled with the node ST (N), and the drain thereof are both coupled to the second power supply VSS2.

Figure 5B:
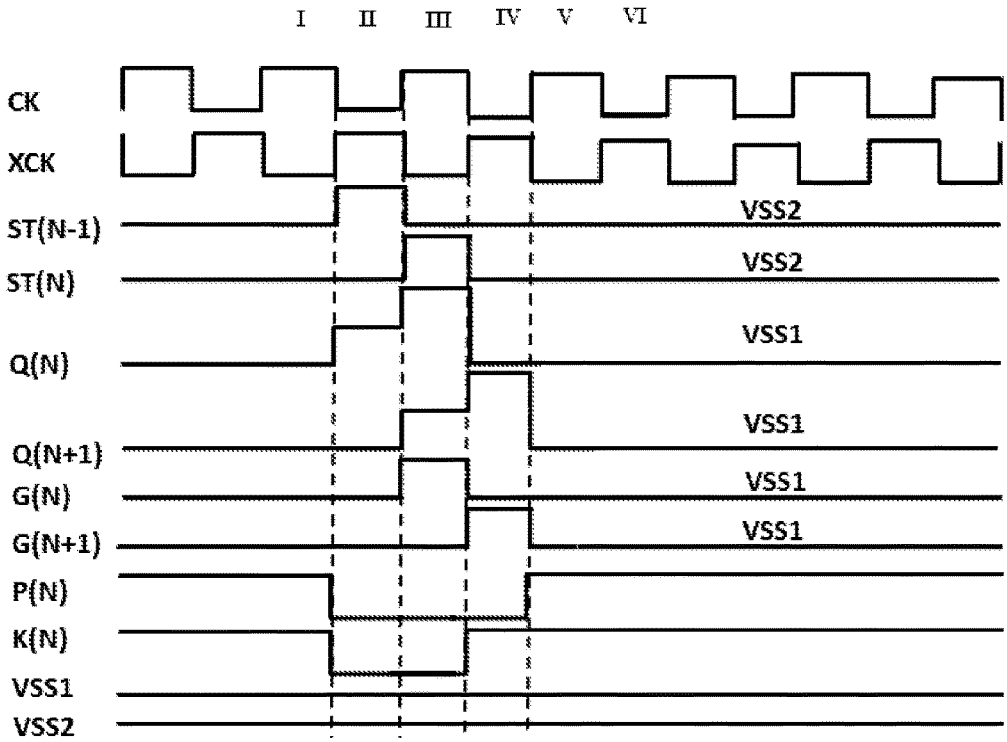
FIG. 5B is a time sequence diagram of signals in the gate driving unit of FIG. 5A.

FIG. 5B shows a time sequence diagram of signals in the gate driving unit shown in FIG. 5A. Different from the gate driving unit of FIG. 3A, when the node P (N) and/or the node K (N) are at high potentials, besides that potentials of the node Q (N) and the node G (N) are pulled down to a potential of the first power supply VSS1, a potential of the node ST (N) is also pulled down to a potential of the second power supply VSS2. Accordingly, because the potential of the node ST (N) is present as the potential of the second power supply VSS2 and VSS2<VSS1<0, a voltage Vgs between the gate and source of the transistor(s) T52 and/or T62 is less than 0, so that the transistor(s) T52 and/or T62 can be turned off thoroughly, and thus attenuation of potential of the node P (N) and/or the node K (N) is effectively prevented.

Figure 6A:
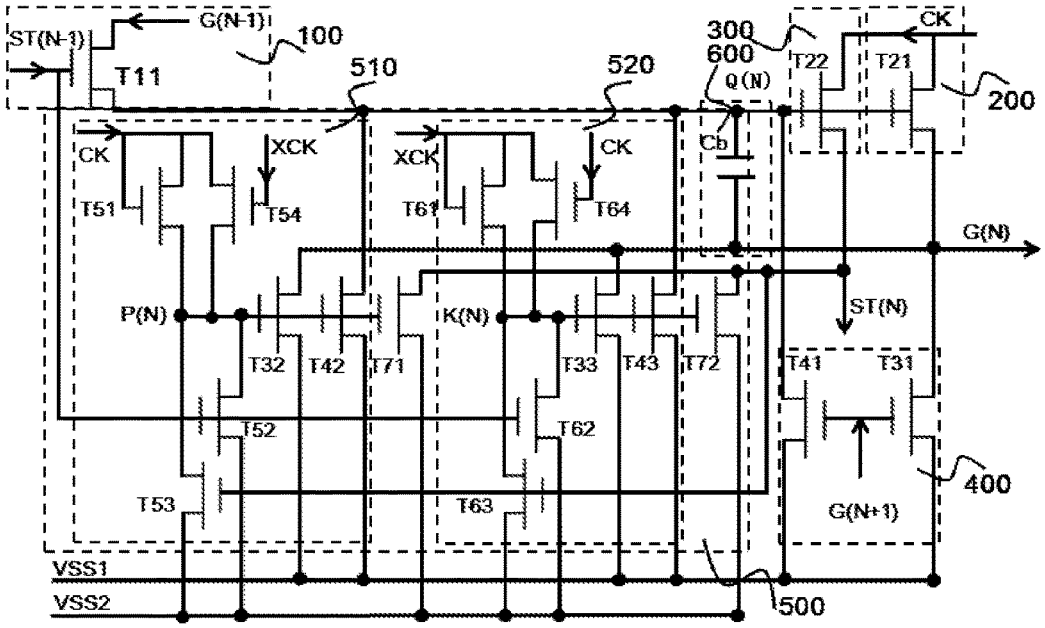
FIG. 6A is a schematic diagram of circuit structure of a gate driving unit according to embodiment IV of the present disclosure.
Figure 6B:
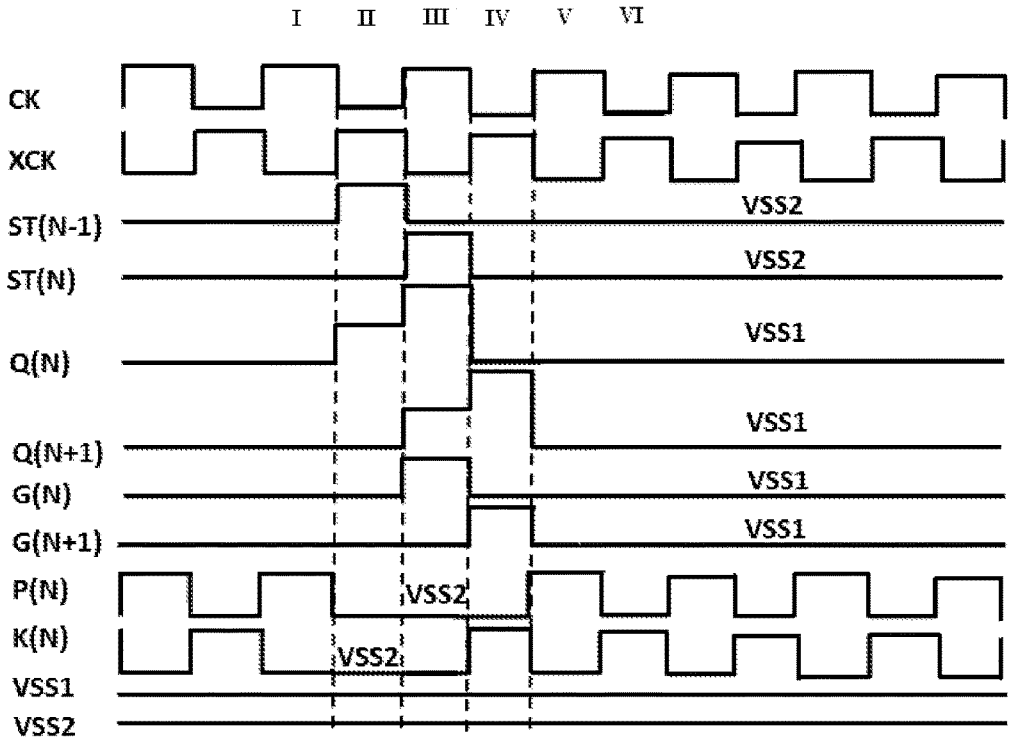
FIG. 6B is a time sequence diagram of signals in the gate driving unit of FIG. 6A.

FIG. 6A shows a schematic diagram of circuit structure of a gate driving unit of embodiment IV according to the present disclosure. This circuit is substantially an integration of the three gate driving units shown in FIG. 3A, FIG. 4A and FIG. 5A, and it is thus equipped with all functions and advantages of these three gate driving units. FIG. 6B shows a time sequence diagram of signals in the gate driving unit shown in FIG. 6A. Since the functions and advantages of each type of the gate driving units have already been introduced in detail above, no further description is made herein.

Figure 7A:
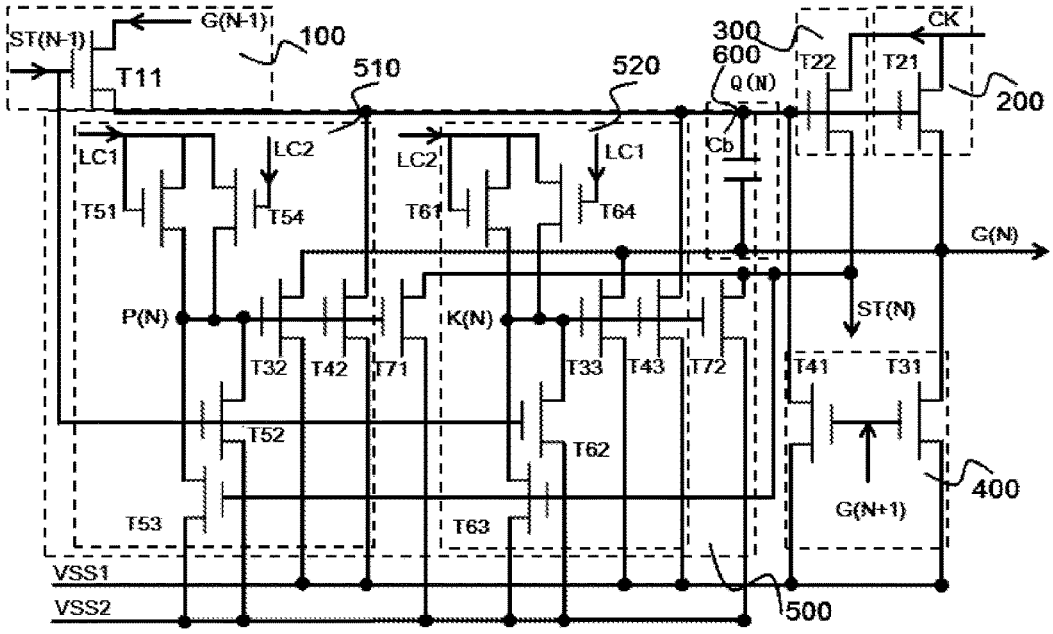
FIG. 7A is a schematic diagram of circuit structure of a gate driving unit according to embodiment V of the present disclosure.

FIG. 7A shows a schematic diagram of circuit structure of a gate driving unit according to embodiment V of the present disclosure. In this circuit, based on the gate driving unit shown in FIG. 6A, the above two pull-down holding control signals input to the two pull-down holding modules 510 and 520 are modified into low-frequency clock signals LC1 and LC2, so as to reduce the power consumption of the whole pull-down holding part 500.

Figure 7B:
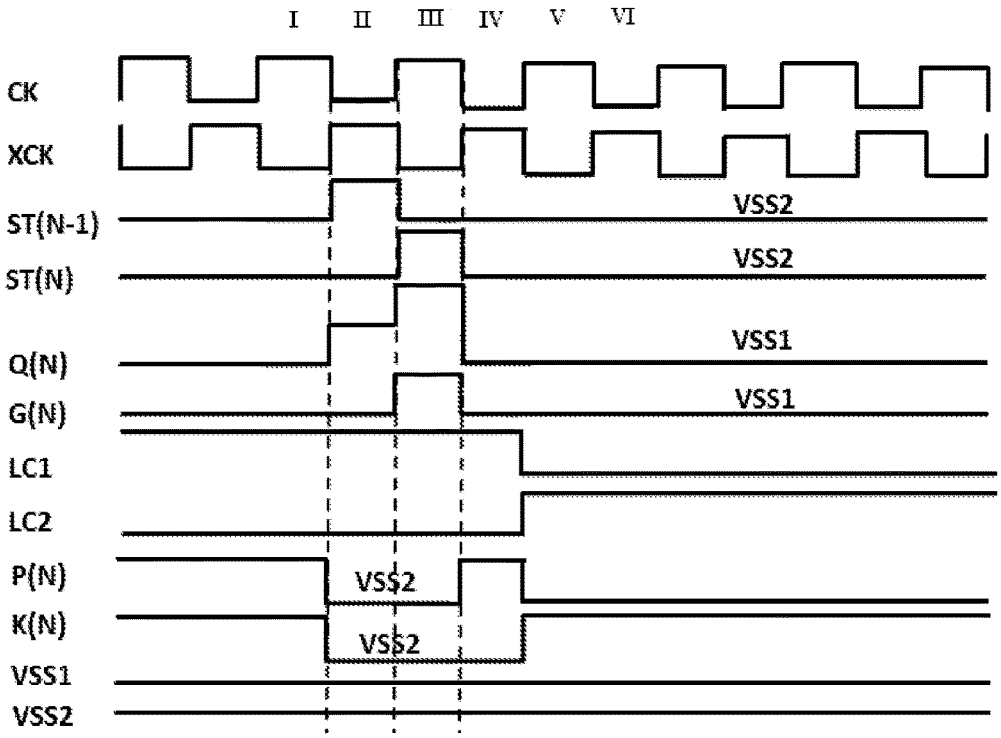
FIG. 7B is a time sequence diagram of signals in the gate driving unit of FIG. 7A.

FIG. 7B shows a time sequence diagram of signals in the gate driving unit shown in FIG. 7A. The operating principle of this circuit will be illustrated in detail below by taking time period IV and time period V as examples.

During the time period IV: as the signal LC1 is of high level while the signal LC2 is low, the transistors T51 and T64 are turned on, and T54 and T61 are turned off. As the node ST (N−1) is at a low potential, the transistors T11, T52 and T62 are all turned off. Meanwhile, since the gate signal G (N+1) output by the $(N+1)^{th}$ gate driving unit is of high level, T31 and T41 are turned on, and potentials of the node Q (N) and the node G (N) are both pulled down to a potential of the first power supply VSS1. Then, because the node Q (N) is at a low potential, T21 and T22 are turned off, and the node ST (N) is at a low potential. As the node ST (N) is of low level, T53 and T63 are both turned off. Accordingly, since the transistor T51 is turned on and the signal LC1 is high, the node P (N) is turned to a high potential; and since T64 is turned on and the signal LC2 is low, the node K (N) is then held at a low potential.

During the time period V: as the signal LC1 is turned to a low potential and the signal LC2 is turned to high, the transistors T51 and T64 are turned off, and the transistors T54 and T61 are turned on. Because the node ST (N−1) is at a low potential, T11, T52 and T62 are all turned off. Then, since T11 is turned off, the transistors T21 and T22 are turned off, and the node ST (N) is at a low potential. Since the node ST (N) is of low level, T53 and T63 are both turned off. Accordingly, since the transistor T54 is turned on and the signal LC1 is of low level, the node P (N) is then turned to a low potential, and T32 and T42 are turned off. Accordingly, since T61 is turned on and the signal LC2 is high, the node K (N) is turned to a high potential, and the transistors T33 and T43 are turned on, so that the potentials of the nodes Q (N) and G (N) are held at a potential of the first power supply VSS1.

It could be seen from above analysis on the signal time sequence that, starting from the time period V, only the pull-down holding module 520 keeps operating to hold the potentials of the node Q (N) and the node G (N) at a potential of the first power supply VSS1. Under such a condition, the stability of the transistors T33 and T43 is relatively low because the transistors T33 and T43 operate in a turn-on state for a long time.

Figure 8A:
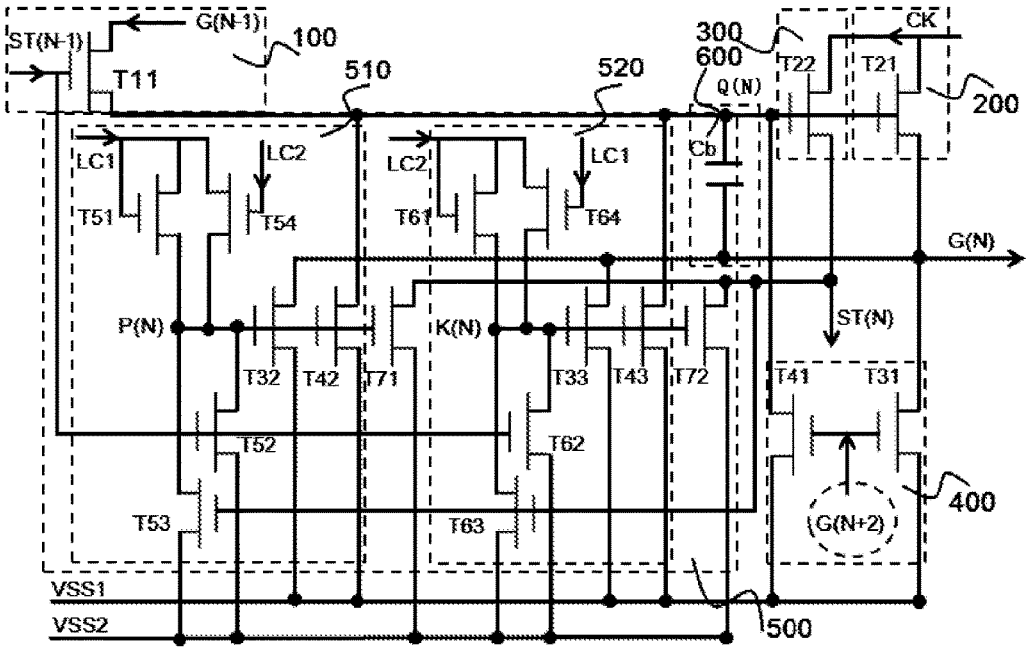
FIG. 8A is a schematic diagram of circuit structure of a gate driving unit according to embodiment VI of the present disclosure.

FIG. 8A shows a schematic diagram of circuit structure of a gate driving unit according to embodiment VI of the present disclosure. In this circuit, based on the gate driving unit shown in FIG. 7A, the pull-down control signal input to the gate of the transistors T41 and T31 of the key pull-down part 400 is modified into a gate signal G (N+2) output by the $(N+2)^{th}$ gate driving unit.

Figure 8B:
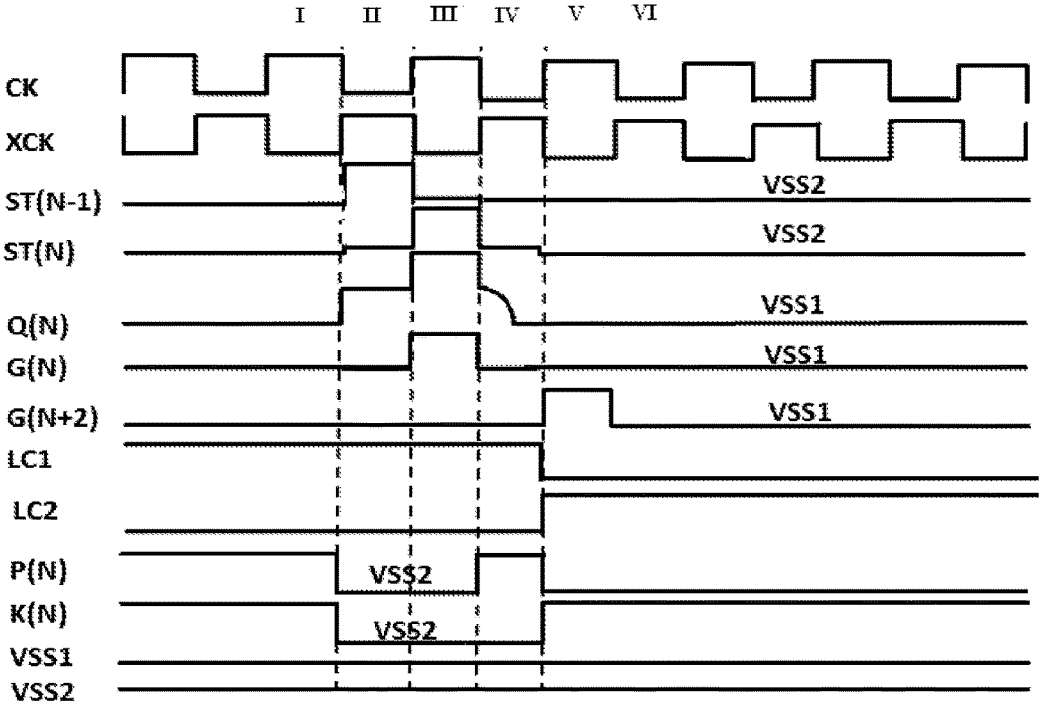
FIG. 8B is a time sequence diagram of signals in the gate driving unit of FIG. 8A.

FIG. 8B shows a time sequence diagram of signals in the gate driving unit shown in FIG. 8A. The operating principle of this circuit will be illustrated in detail below by taking time period IV as an example.

During the time period IV: as the signal CK is of low level and the signal XCK is of high, the transistor T51 is turned off and T61 is turned on. As the node ST (N−1) is at a low potential, T11, T52 and T62 are all turned off. Meanwhile, only when the gate signal G (N+2) output by the $(N+2)^{th}$ gate driving unit is at a high potential, the transistors T31 and T41 are turned on. Thus, in this embodiment, the potential of the node Q (N) is gradually, instead of directly, pulled down to a potential of the first power supply VSS1, and thereby T21 and the T22 could be completely turned off only after a certain delay, as a result of which the node ST (N) and the node G (N) can be directly pulled down to a low potential of the signal CK. Then, because the node ST (N) is at a low potential, the transistors T53 and T63 are both turned off. Accordingly, since T51, T52 and T53 are turned off, the node P (N) is held at the low potential; and since T61 is turned on and the signal XCK is high, the node K (N) is at a high potential as the same as the signal XCK.

Figure 9:
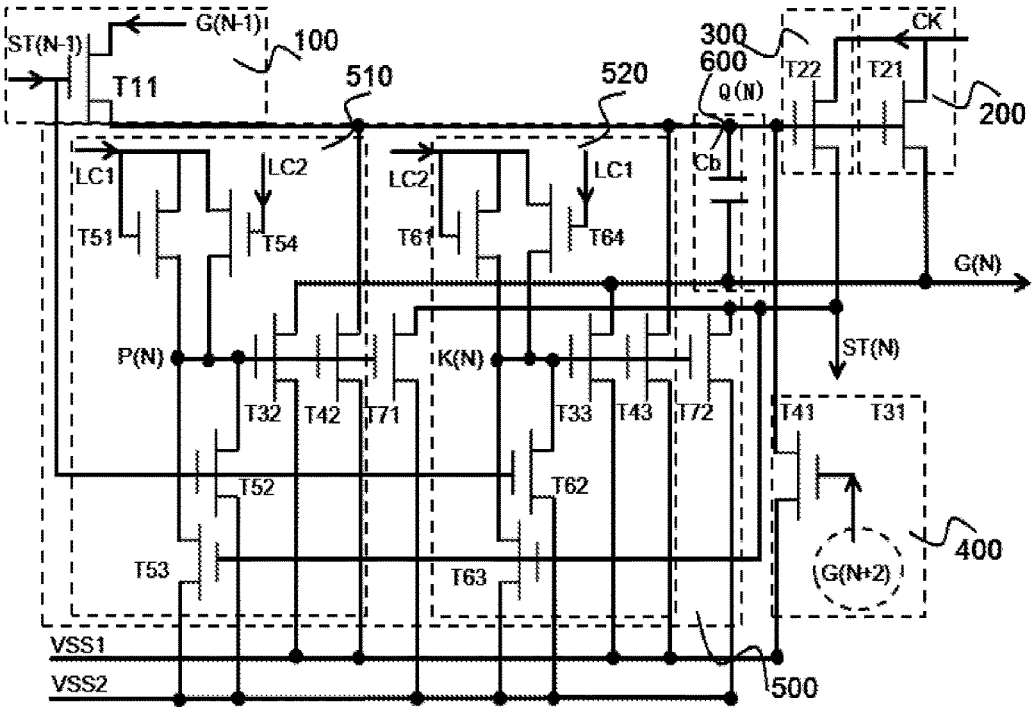
FIG. 9 is a schematic diagram of circuit structure of a gate driving unit according to embodiment VII of the present disclosure.

Further, in the above-mentioned key pull-down part 400, because the potential of the node G (N) can be pulled down to a low potential through only the transistor T22 during the time period IV and can be held at the low potential only by means of the pull-down holding modules 510 and 520 during the time period V, the transistor T31 thereby can be removed (see a gate driving unit of embodiment VII shown in FIG. 9). The operating manner of the gate driving unit with the transistor T31 being removed is not changed, and the signal time sequence diagram thereof is totally the same as that of FIG. 8B, and thus no further description is made herein.

Figure 10A:
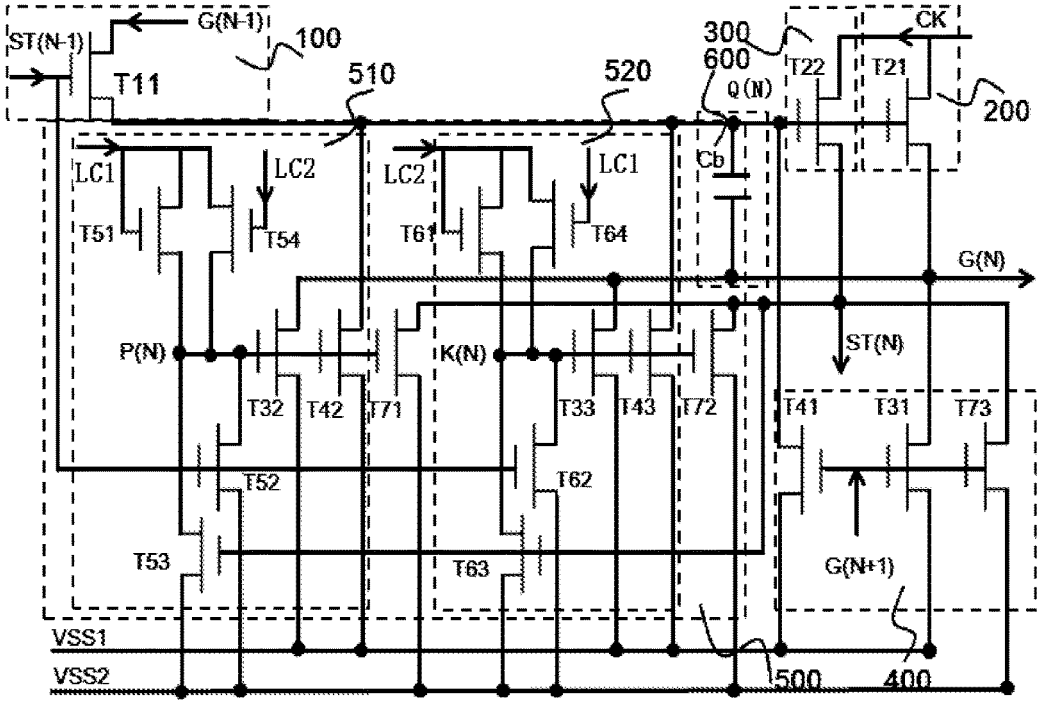
FIG. 10A is a schematic diagram of circuit structure of a gate driving unit according to embodiment VIII of the present disclosure.

FIG. 10A shows a schematic diagram of circuit structure of a gate driving unit according to embodiment VIII of the present disclosure. An improvement for this circuit is made to the key pull-down part 400 on the basis of the gate driving unit shown in FIG. 7A. Specifically, a transistor T73 is newly added into this circuit to enhance the pull-down capability of the key pull-down part 400, wherein the gate of the transistor T73 is coupled with G (N+1), the source of the transistor T73 is coupled with the node ST (N), and the drain thereof is coupled to the second power supply VSS2.

Figure 10B:
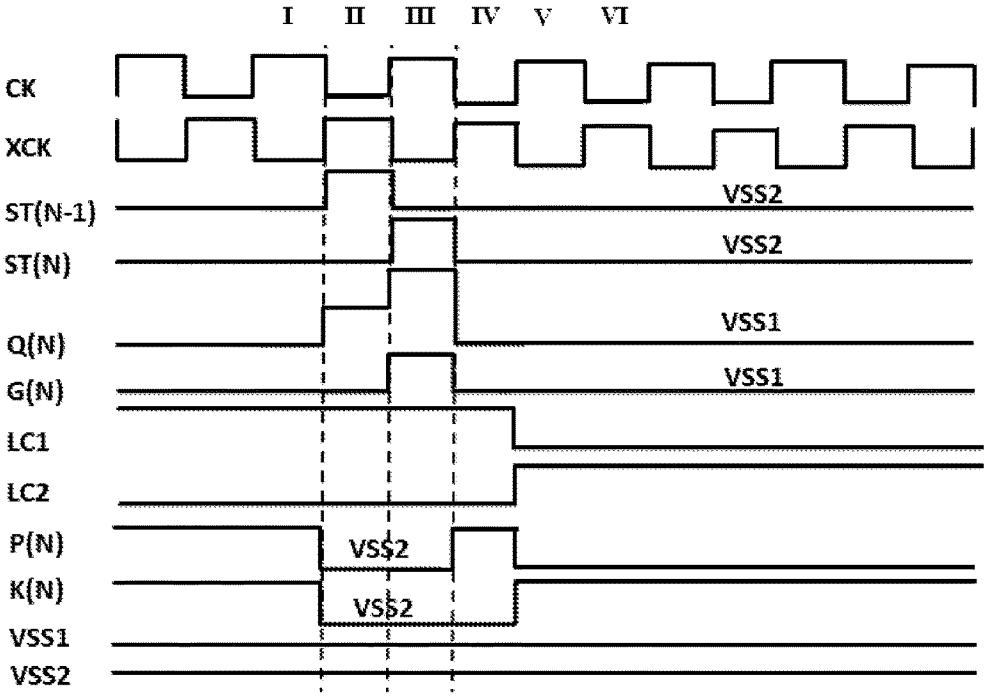
FIG. 10B is an ideal time sequence diagram of signals in the gate driving unit of FIG. 10A.

FIG. 10B shows a time sequence diagram of signals in the gate driving unit of FIG. 10A which is under an ideal condition. The operating principle of this circuit will be illustrated in detail below by taking time period IV and time period V as examples.

During the time period IV: as the signal LC1 is of high level while the signal LC2 is of low, the transistors T51 and T64 are turned on, and T54 and T61 are turned off. As the node ST (N−1) is at a low potential, the transistors T11, T52 and T62 are all turned off. Then, because the gate signal G (N+1) output by the $(N+1)^{th}$ gate driving unit is of high level, T31, T41 and T73 are turned on, so that the potentials of the node Q (N) and the node G (N) are both pulled down to a potential of the first power supply VSS1. As a result, the potential of the node ST (N) is directly pulled down to a potential of the second power supply VSS2. Then, since the node ST (N) is at a low potential, the transistors T53 and T63 are turned off. Accordingly, since T51 is turned on and the signal LC1 is high, the node P (N) is turned to high; and since T64 is turned on and LC2 is of low level, the node K (N) is held at a low potential.

During the time period V: as the signal LC1 is turned to a low level and the signal LC2 is turned to high, the transistors T51 and T64 are turned off, and T54 and T61 are turned on. As the node ST (N−1) is at a low potential, the transistors T11, T52 and T62 are all turned off. Meanwhile, since the gate signal G (N+1) output by the $(N+1)^{th}$ gate driving unit is of low level, T31, T41 and T73 are turned off. Then, because T11 is turned off, the transistors T21 and T22 are both turned off, and the node ST (N) is held at a low potential. Since the node ST (N) is at a low potential, T53 and T63 are turned off. Accordingly, since T54 is turned on and the signal LC1 is low, the node P (N) is turned to a low potential, and T32 and T42 are turned off. Moreover, since T61 is turned on and the signal LC2 is of high level, the node K (N) is turned to a high potential, and the T33 and the T43 are turned on. As a result, the potentials of the node Q (N) and the node G (N) are continuously held at a potential of the first power supply VSS1.

Figure 10C:
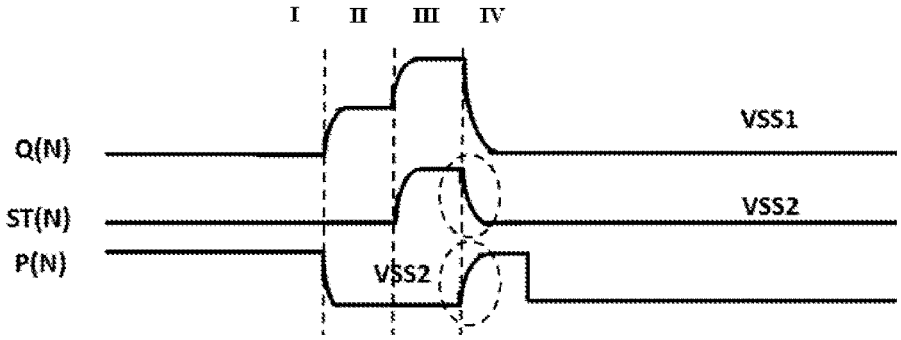
FIG. 10C is a simulated time sequence diagram of signals in the gate driving unit of FIG. 10A.
Figure 10D:
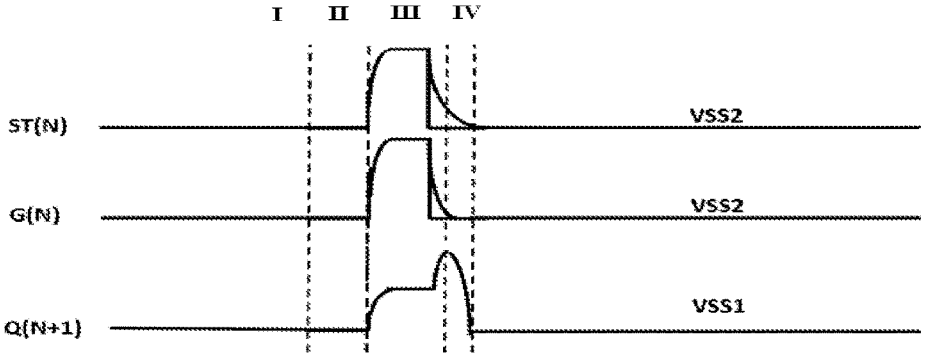
FIG. 10D is a schematic diagram showing that a signal Q (N+1) in the gate driving unit of FIG. 10A can not be raised up to a normal potential.

FIG. 10C show a time sequence diagram of signals in the gate driving unit shown in FIG. 10A which is under a practical condition. It could be seen from FIG. 10C that, the potential of the node ST (N) is pulled down to a potential of the first power supply VSS1, so that the potentials of the node P (N) and the node K (N) can be quickly rised up, enhancing the response capability of the gate driving unit. This is particularly important for a large-sized liquid crystal display panel. However, in a practical application, the transistor T73 should not be too large considering the load capability of the transfer signal ST (N), and thereby the pull-down capability of the transistor T73 is limited. Particularly, when a delay time for decline of potential of the node ST (N) exceeds that of the node G (N), relatively serious leak current may occur at the node Q (N), so that Q (N+1) of the next frame can not be raised up to a normal potential (as shown in FIG. 10D). Therefore, other approaches should be applied to the key pull-down part 400 to further strengthen its pull-down capability.

Figure 11A:
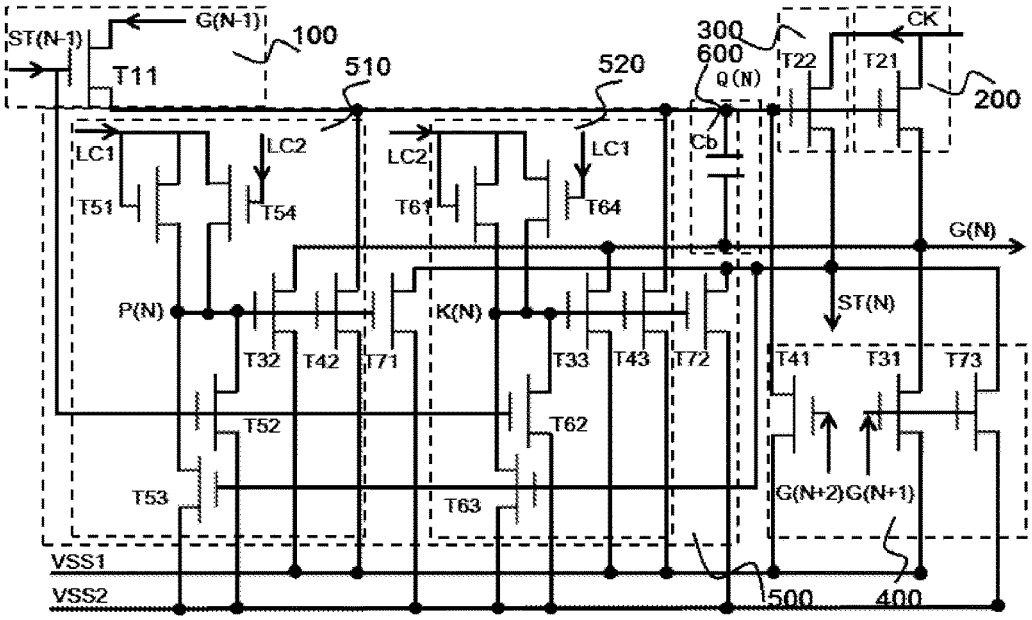
FIG. 11A is a schematic diagram of circuit structure of a gate driving unit according to embodiment IX of the present disclosure.

FIG. 11A shows a schematic diagram of circuit structure of a gate driving unit according to embodiment IX of the present disclosure. An further improvement for this circuit is made to the key pull-down part 400 on the basis of the gate driving unit shown in FIG. 10A. Specifically, the pull-down control signal input to the gate of the transistor T41 is modified into a gate signal G (N+2) output by the $(N+2)^{th}$ gate driving unit, and the pull-down control signal input to the gates of the transistors T31 and T73 remains to be the gate signal G (N+1) output by the $(N+1)^{th}$ gate driving unit.

Figure 11B:
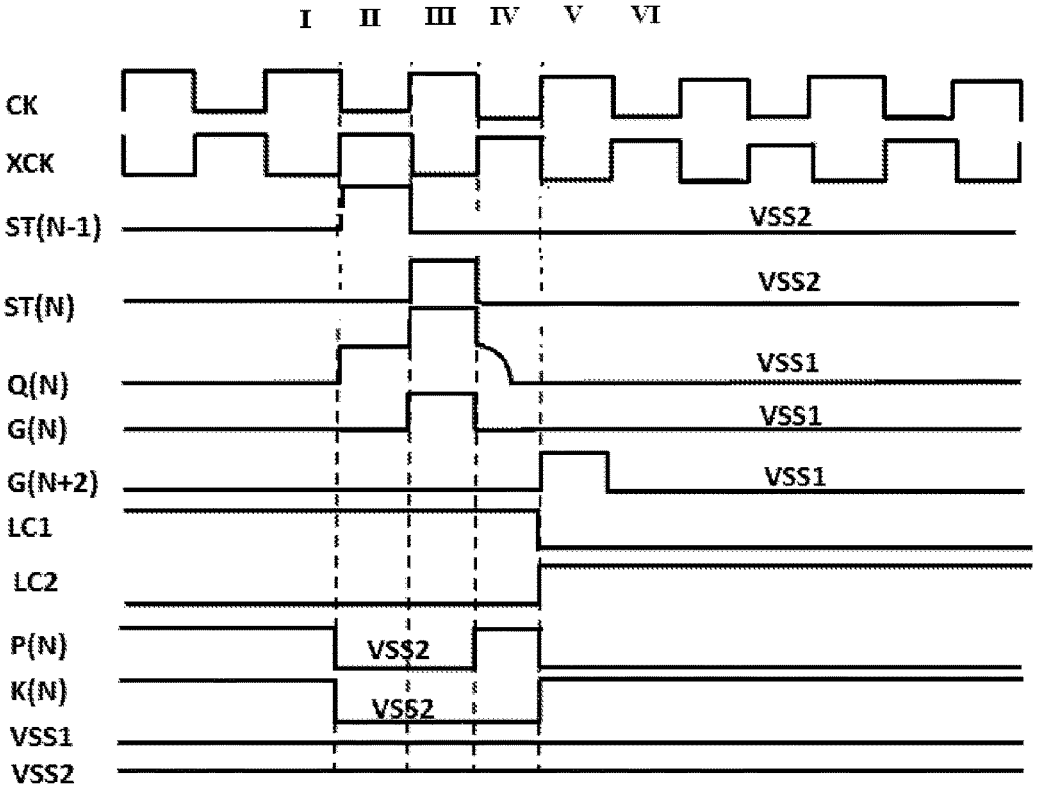
FIG. 11B is a time sequence diagram of signals in the gate driving unit of FIG. 11A.

FIG. 11B shows a time sequence diagram of signals in the gate driving unit shown in FIG. 11A which is under an ideal condition. The operating principle of this circuit will be illustrated in detail below by taking time period IV and time period V as examples.

During the time period IV: as the signal LC1 is of high level while LC2 is of low, the transistors T51 and T64 are turned on, and T54 and T61 are turned off. As the node ST (N−1) is at a low potential, the transistors T11, T52 and T62 are turned off. At the meanwhile, since the gate signal G (N+1) output by the $(N+1)^{th}$ gate driving unit is high and the gate signal G (N+2) output by the $(N+2)^{th}$ gate driving unit is of low level, T31 and T73 are both turned on, and T41 is turned off. Meanwhile, since the potential of the node Q (N) is gradually, instead of directly, pulled down to a potential of the first power supply VSS1, the transistors T21 and T22 cannot be completely turned off until a certain delay. Thereby, under the co-action of the transistors T21 and T31, the node G (N) is pulled down to a low potential, and under the co-action of the transistors T22 and T73, the node ST (N) is pulled down to a low potential. Then, since the node ST (N) is at a low potential, T53 and T63 are both turned off. Accordingly, because T51 is turned on and the signal LC1 is high, the node P (N) is turned to a high potential, and because T64 is turned on and the signal LC2 is low, the node K (N) is held at a low potential.

During the time period V: as the signal LC1 is turned to low and LC2 is turned to high, the transistors T51 and T64 are turned off, and T54 and T61 are turned on. As the node ST (N−1) is at a low potential, the transistors T11, T52 and T62 are all turned off. Meanwhile, since the gate signal G (N+1) output by the $(N+1)^{th}$ gate driving unit is of low level and the gate signal G (N+2) output by the $(N+2)^{th}$ gate driving unit is of high, T31 and T73 are both turned off, and T41 is turned on. Then, since T41 is turned on, the potential of the node Q (N) is held at a potential of the first power supply VSS1. Because the node Q (N) is at a low potential, T21 and T22 are turned off. Then, as the T21 is turned off, the node ST (N) is held at a low potential. Since the node ST (N) is at a low potential, the transistors T53 and T63 are both turned off. Accordingly, as T54 is turned on and the signal LC1 is of low level, the node P (N) is turned to a low potential, and T32 and T42 are turned off. Moreover, since T61 is turned on and the signal LC2 is high, the node K (N) is turned to a high potential, and the T33 and the T43 are turned on. As a result, the potentials of the node Q (N) and the node G (N) are continuously held at a potential of the first power supply VSS1.

Figure 12:
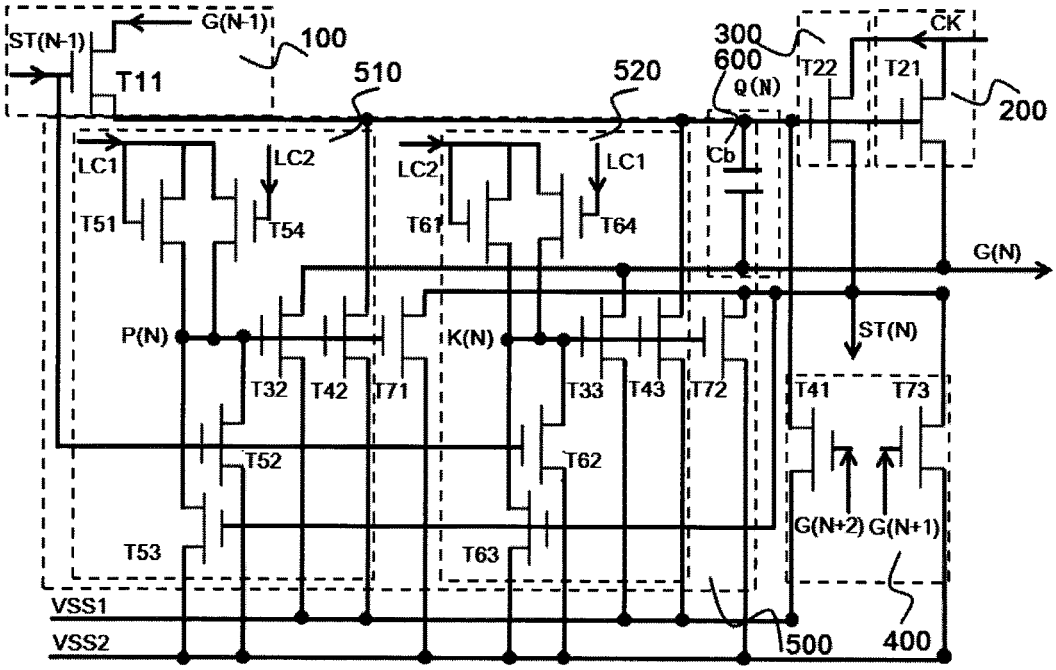
FIG. 12 is a schematic diagram of circuit structure of a gate driving unit according to embodiment X of the present disclosure.

Further, in the above-mentioned key pull-down part 400, because the potential of the node G (N) can be pulled down to a low potential through only the transistor T22 during the time period IV and can be held at a low potential through only the pull-down holding modules 510 and 520 during the time period V, the transistor T31 can thereby be removed (see a gate driving unit of embodiment X shown in FIG. 12). The operating manner of the gate driving unit with removal of the transistor T31 is not changed, and the signal time sequence diagram thereof is totally the same as that of FIG. 11B, thus no further description will be made herein.

Figure 13A:
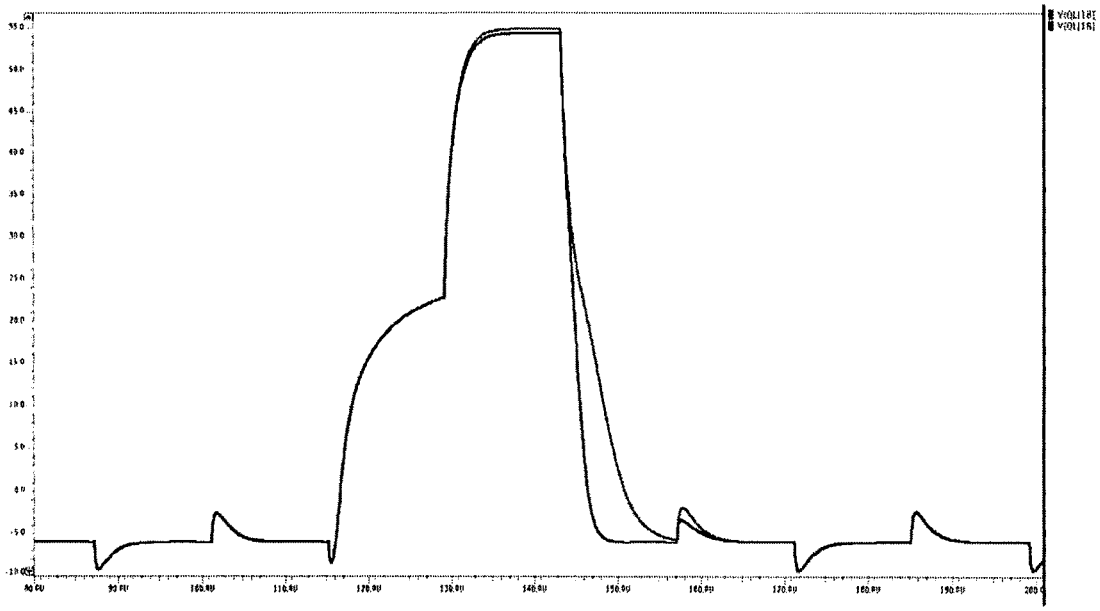
FIG. 13A is a signal waveform diagram of a node Q (N) in the gate driving unit of FIG. 11A.
Figure 13B:
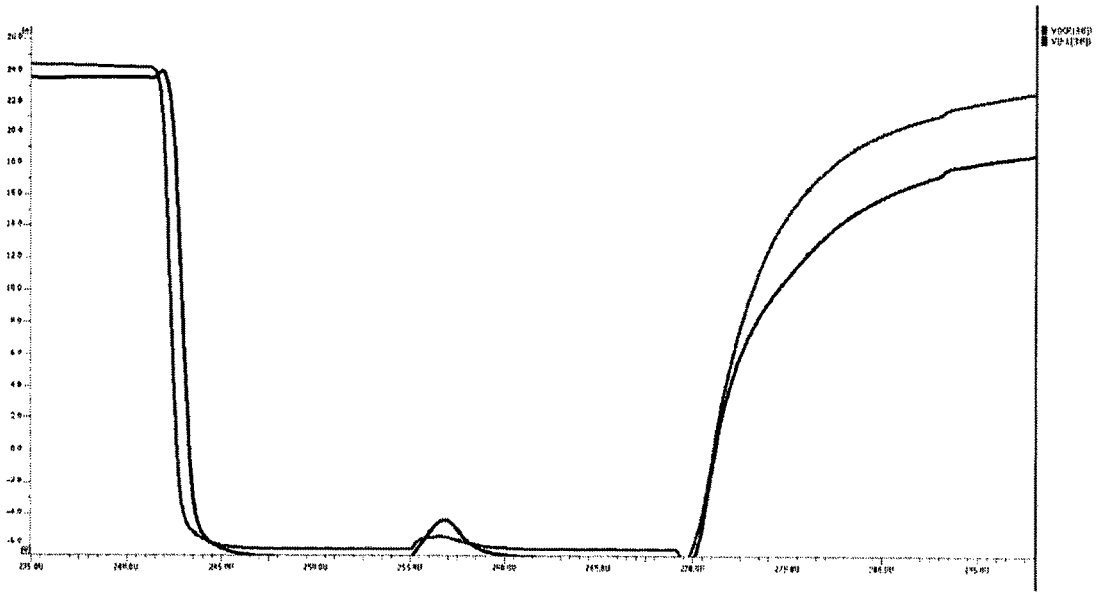
FIG. 13B is a signal waveform diagram of nodes P (N) and K (N) in the gate driving unit of FIG. 11A.

FIG. 13A is a signal waveform diagram of the node Q (N), and FIG. 13B is a signal waveform diagram of the node P (N) and the node K (N). It could be seen from the figures that, the operating performance of the gate driving circuit is stable, the gate voltage difference between two adjacent gate driving units is less than 0.1V, and each of the gate driving units can realize complete output.

In the above ten embodiments, the first power supply VSS1 is configured to pull down the potentials of the node G (N) and the node Q (N), and the second power supply VSS2 is configured to pull down the potentials of the node P (N) and the node K (N) and, if it is necessary, also to pull down the potential of the node ST (N), so that the leak current loops L100 and L200 due to the voltage difference between these two negative power supplies can be eliminated. It should be noted that, the technical solution proposed by the present disclosure is not limited to so. In a practical application, it is possible to eliminate only the leak current loop L200 as per needs. Accordingly, the gate driving circuit towards such condition and the operating principle thereof will be illustrated in detail below with reference to the accompanying drawings and embodiments.

Figure 14A:
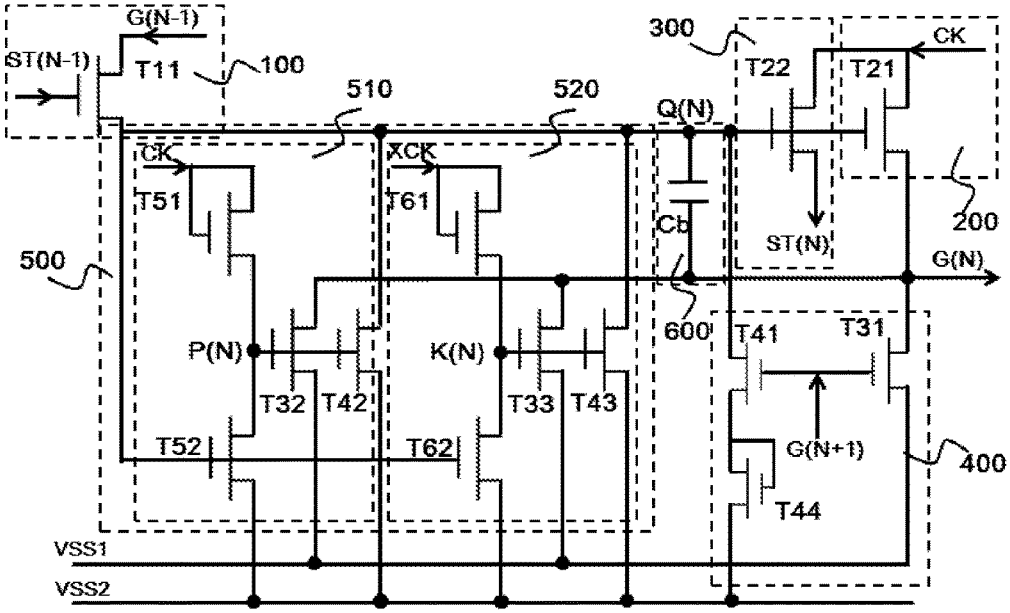
FIG. 14A is a schematic diagram of circuit structure of a gate driving unit according to embodiment XI of the present disclosure.

FIG. 14A shows a schematic diagram of circuit structure of a gate driving unit according to embodiment XI of the present disclosure. An improvement is also made to this circuit on the basis of the gate driving unit shown in FIG. 2A. Specifically, a transistor T44 is newly added into the key pull-down part 400, wherein the gate of the transistor T44 is in short connection with its source and is then coupled with the drain of the transistor T41, and the drain of the transistor T44 is coupled to the second power supply VSS2. The transistor T44 is equivalent to a diode of which the anode is connected with the source of the transistor T41, so as to prevent the leak current from flowing to the first power supply VSS1 from the second power supply VSS2. Typically, the transistor T44, only when a channel width of which is set as 5~10 times of the transistor T41, can effectively prevented crosstalk current between the two negative power supplies, namely the leak current.

Figure 14B:
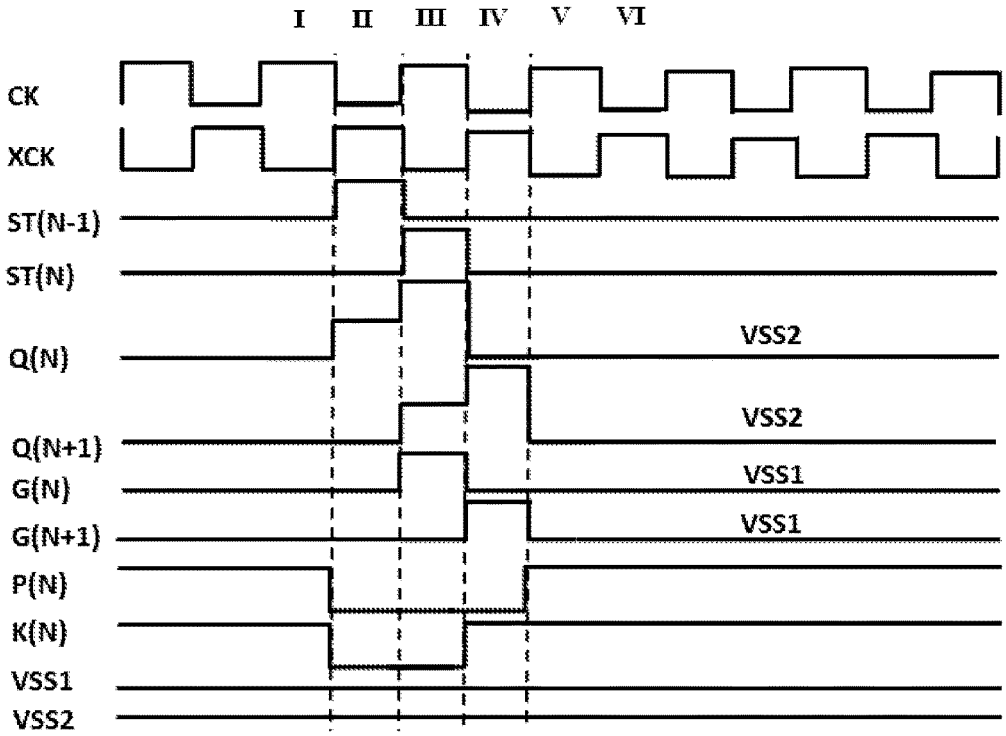
FIG. 14B is a time sequence diagram of signals in the gate driving unit of FIG. 14A.

FIG. 14B shows a time sequence diagram of signals in the gate driving unit shown in FIG. 14A, wherein the first clock signal CK and the second clock signal XCK are two serials of pulse signals of which the phases are complementary.

During time period I: as the signal CK is of high level while the signal XCK is of low level, the transistor T51 is turned on and T61 is turned off. As the node ST (N−1) is at a low potential, T11 is turned off. Then, since T11 is turned off, T21 and T22 are turned off, and T52 and T62 are also turned off. As T21 and T22 are turned off, the node ST (N) is at a low potential. Accordingly, since T51 is turned on and the signal CK is of high level, the node P (N) is at a high potential as the same as the signal CK; and since T61 and T62 are turned off, the node K (N) still keeps a high potential because of the signal XCK in the previous one time period is high (due to the lack of a discharge path). Then, as the node P (N) and the node K (N) are at high potentials, the transistor T32 and T42 are both turned on, T33 and T43 are also turned on, so that the potential of the node Q (N) is pulled down to a potential of the second power supply VSS2, and the potential of the node G (N) is pulled down to a potential of the first power supply VSS1.

During time period II: as the signal CK is of low level while the signal XCK is of high, the transistor T51 is turned off and T61 is turned on. As the node ST (N−1) is at a high potential, T11 is turned on. Then, since T11 is turned on and the gate signal G (N−1) output by the $(N-1)^{th}$ gate driving unit is of high level, the transistors T21 and T22 are turned on, T52 and T62 are also turned on. Meanwhile, the capacitance Cb is charged to a first potential under the action of the signal G (N−1), that is, the potential of the node Q (N) is raised up to a first potential. Accordingly, since T22 is turned on and the signal CK is low, the node ST (N) is at a low potential; and since T52 and T62 are turned on, the potentials of the nodes P (N) and K (N) are both pulled down to a potential of the second power supply VSS2, so that the transistors T32 and T42 are turned off, and T33 and T43 are also turned off; and since T21 is turned on but the signal CK is at a low potential, the node G (N) is then held at a low potential.

During time period III: as the signal CK is of high level while the signal XCK is of low, the transistor T51 is turned on and T61 is turned off. As the node ST (N−1) is at a low potential, T11 is turned off. Meanwhile, due to the energy storage effect of the capacitance Cb, the gates of T21 and T22 are still held at high potentials, so that T21 and T22 are kept turn-on, Similarly, the transistors T52 and T62 are also kept on. Then, since T22 is turned on and the signal CK is of high potential, the node ST (N) is at a high potential as the same as the signal CK. As T52 and T62 are turned on, the potentials of the nodes P (N) and K (N) are still held at a potential of the second power supply VSS2, so that T32 and T42 are both turned off, and T33 and T43 are also turned off. Because CK is high, the capacitance Cb is recharged, under the action of CK, to a second potential higher than the first potential, namely the potential of the node Q (N) is raised up to the second potential higher than the first potential. Meanwhile, since T21 is turned on and the signal CK is of high level, the node G (N) is at a high potential as the same as the signal CK.

During time period IV: as the signal CK is of low level while the signal XCK is of high, the transistor T51 is turned off and T61 is turned on. As the node ST (N−1) is at a low potential, T11 is turned off. Meanwhile, since the gate signal G (N+1) output by the $(N+1)^{th}$ gate driving unit is of high level, T31 and T41 are turned on. Then, as T41 is turned on and the potential of the node Q (N) begins declining from the second potential, the transistor T44 thereby is in a turn-on state for a short time till the potential of the node Q (N) is close to a potential of the second power supply VSS2. Since T31 is turned on, the potential of the node G (N) is pulled down to a potential of the first power supply VSS1. When the potential of the node Q (N) is pulled down to the potential of the second power supply VSS2, T21 and T22 are turned off, and T52 and T62 are also turned off, and then the node ST (N) is at a low potential. Accordingly, since T51 and T52 are turned off, the node P (N) is held at a low potential; and since T61 is turned on and the signal XCK is high, the node K (N) is at a high potential as the same as the signal XCK.

During time period V: as the signal CK is of high level while the signal XCK is of low, the transistor T51 is turned on and T61 is turned off. As the node ST (N−1) is at a low potential, T11 is turned off. Because the potential of the node Q (N) in the previous one time period is already pulled down to a potential of the second power supply VSS2, T21 and T22 are turned off. Then, since T21 and T22 are turned off, the node ST (N) is at a low potential. Meanwhile, as the gate signal G (N+1) output by the $(N+1)^{th}$ gate driving unit is of low level, the transistors T31 and T41 are turned off. Accordingly, since T51 is turned on and the signal CK is high, the node P (N) is at a high potential as the same as the signal CK; and since T61 and T62 are turned off, the node K (N) still keeps a high potential because the signal XCK in the previous one time period is of high level (due to lack of a discharge path). Because the node P (N) and the node K (N) both are at high potentials, T32 and T42 are turned on, T33 and T43 are also turned on, so that the potential of the node Q (N) is still held at a potential of the second power supply VSS2. As a result, the potential of the node G (N) is still held at a potential of the first power supply VSS1.

During time period VI: as the signal CK is of low level while the signal XCK is of high, the transistor T51 is turned off and T61 is turned on. As the node ST (N−1) is at a low potential, T11 is turned off. Meanwhile, since the potential of the node Q (N) in the previous one time period is held at a potential of the second power supply VSS2, T21 and T22 are turned off. Then, as T21 and T22 are turned off, the node ST (N) is at a low potential. Since the gate signal G (N+1) output by the $(N+1)^{th}$ gate driving unit is of low level, T31 and T41 are turned off. As the transistors T51 and T52 are turned off, the node P (N) still keeps a high potential because the signal CK in the previous one time period is of high level (due to lack of a discharge path). Accordingly, since T61 is turned on and the signal XCK is high, the node K (N) is at a high potential as the same as the signal CK; and since the node P (N) and the node K (N) both are at high potentials, the transistors T32 and T42 are turned on, and T33 and T43 are also turned on, so that the potential of the node Q (N) is still held at a potential of the second power supply VSS2. As a result, the potential of the node G (N) is still held at a potential of the first power supply VSS1.

Figure 15A:
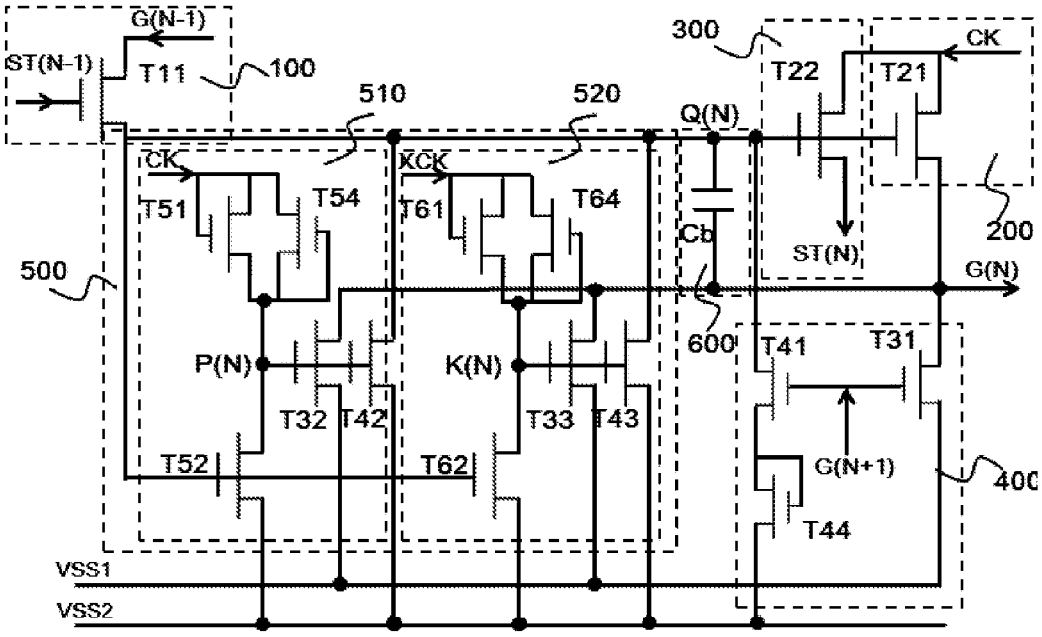
FIG. 15A is a schematic diagram of circuit structure of a gate driving unit according to embodiment XII of the present disclosure.

FIG. 15A shows a schematic diagram of circuit structure of a gate driving unit according to embodiment XII of the present disclosure. An improvement for this circuit is made to the pull-down holding part 500 on the basis of the gate driving unit shown in FIG. 14A. Specifically, transistors T54 and T64 are newly added into this circuit to constitute, respectively, discharge paths of the node P (N) and the node K (N).

The gate of the transistor T54 is in short connection with its drain and is then coupled with the node P (N), and the source of the transistor T54 is coupled with the source of the transistor T51 to receive the first clock signal CK. The transistor T54 is equivalent to a diode of which the anode is connected with the node P (N), so as to quickly pull down the potential of the node P (N) to a low potential of the first clock signal CK.

The gate of the transistor T64 is in short connection with its drain and is also coupled with the node P (N), and the source of the transistor T64 is coupled with the source of the transistor T61 to receive the second clock signal XCK. The transistor T64 is equivalent to a diode of which the anode is connected with the node K (N) to quickly pull down the potential of the node K (N) to a low potential of the second clock signal XCK.

Figure 15B:
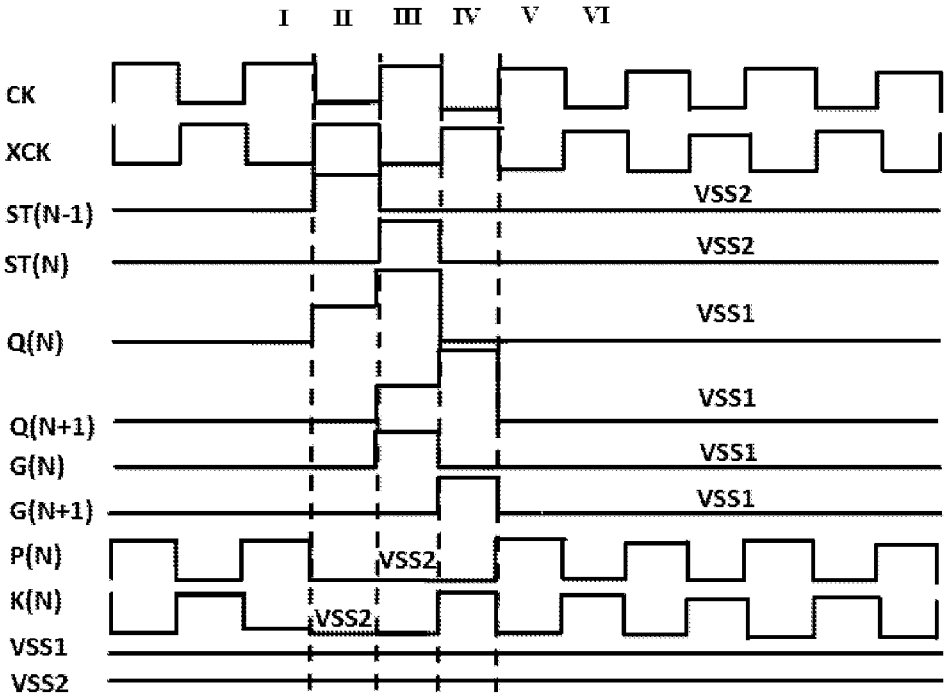
FIG. 15B is a time sequence diagram of signals in the gate driving unit of FIG. 15A.

FIG. 15B shows a time sequence diagram of signals in the gate driving unit shown in FIG. 15A. The operating principle of this circuit will be illustrated in detail below by taking time period V and time period VI as examples.

During the time period V: as the signal CK is of high level while the signal XCK is of low, the transistors T51 and T64 are turned on, and T54 and T61 are turned off. Then, as T51 is turned on and the signal CK is high, the node P (N) is at a high potential as the same as the signal CK. Although T61 is turned off, T64 is turned on, so that the potential of the node K (N) is quickly pulled down to a low potential of the signal XCK through the transistor T64.

During the time period VI: as the signal CK is of low level while the signal XCK is of high, the transistors T51 and T64 are turned off, and T54 and T61 are turned on. Although T51 is turned off, T54 is turned on, so that the potential of the node P (N) is quickly pulled down to a low potential of the signal CK by means of the transistor T64. Meanwhile, since T61 is turned on and the signal XCK is of high level, the node K (N) is at a high potential as the same as the signal CK.

It could be seen from the above analysis on the signal time sequence that, the transistors T54 and T64 in this embodiment are different from the transistors T54 and T64 in embodiment II in their connection manner, but the operating principle thereof are same for achieving the same technical effects.

Figure 16A:
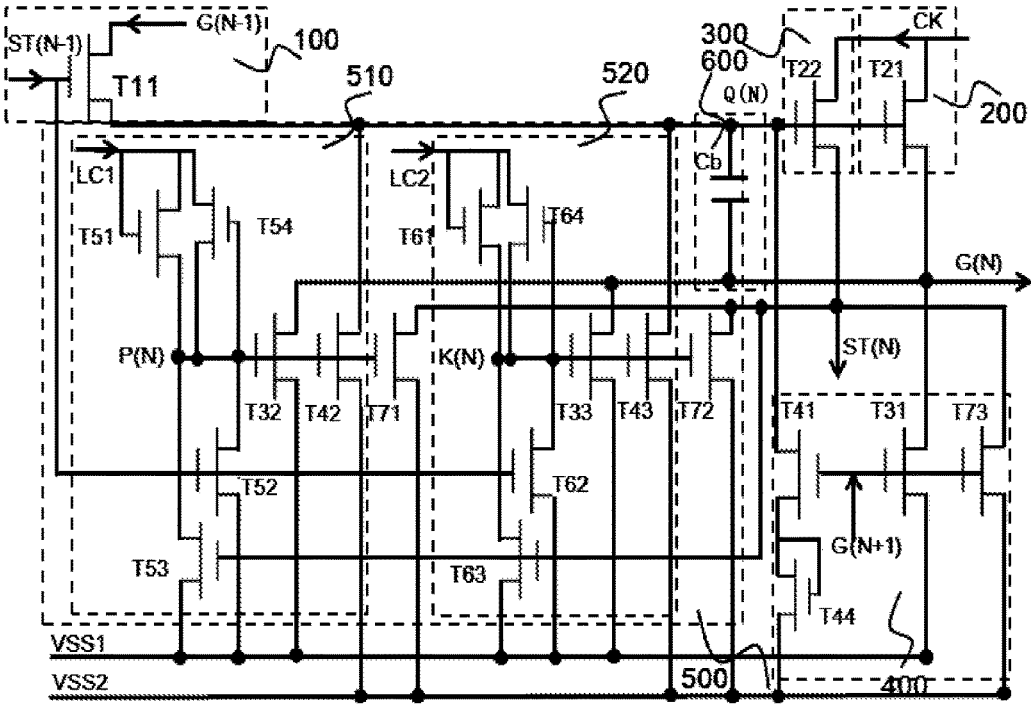
FIG. 16A is a schematic diagram of circuit structure of a gate driving unit according to embodiment XIII of the present disclosure.

FIG. 16A shows a schematic diagram of circuit structure of a gate driving unit according to embodiment XIII of the present disclosure. This circuit is very similar to the circuit structure of the gate driving unit of embodiment VIII, except that the first power supply VSS1 is configured to pull down the potentials of the nodes G (N), P (N) and K (N), and the second power supply VSS2 is configured to pull down the potentials of the nodes Q (N) and ST (N). The transistors T54 and T64 therein adopt a connection manner of the transistors T54 and T64 in the embodiment XII. Further, a transistor T44 is added into the key pull-down part to prevent the leak current from flowing to the first power supply VSS1 from the second power supply VSS2.

Figure 16B:
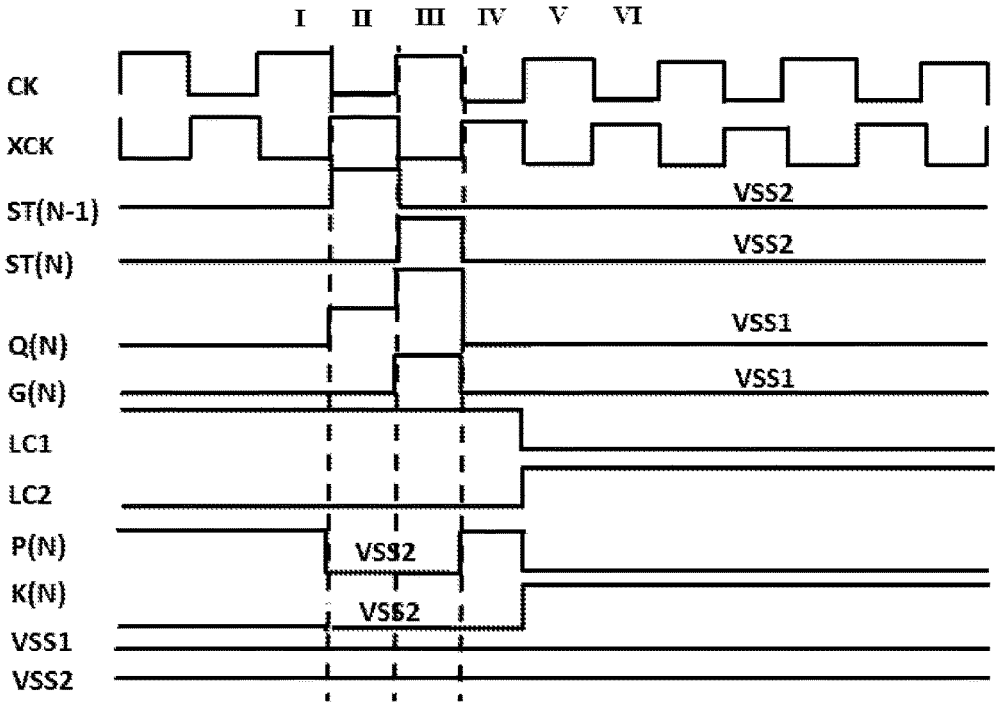
FIG. 16B is a time sequence diagram of signals in the gate driving unit of FIG. 16A.

FIG. 16B shows a time sequence diagram of signals in the gate driving unit shown in FIG. 16A. The operating principle of the gate driving unit of this embodiment is the same as that of the gate driving unit of the embodiment VIII, so no further description will be made herein.

Since the signal ST (N+1) is synchronous with the signal G (N+1), the signal G (N+1) in the above-mentioned embodiments may be substituted by the signal ST (N+1).

Although the implementations of the present disclosure are described above, the contents are merely implementations adopted for better understanding of the present disclosure, rather than limiting the present disclosure. Any modifications and variations made on the implementation form and detail by those skilled in the art without departing from the disclosed spirit and scope of the present disclosure shall fall within the patent protection scope of the present disclosure.

The invention claimed is:

1. A gate driving circuit including a multiple of gate driving units, wherein a $N^{th}$ gate driving unit comprises:

a pull-up control part, for outputting a pull-up control signal;

a pull-up part, a control end of which is coupled with an output end of the pull-up control part, the pull-up part being configured to pull up a potential of a gate signal output end according to the pull-up control signal and a clock signal, so that the $N^{th}$ gate driving unit outputs a gate signal;

a transfer part, a control end of which is coupled with the output end of the pull-up control part, the transfer part being configured to output a transfer signal according to the pull-up control signal and the clock signal;

a key pull-down part, which is coupled among the gate signal output end, the control ends of the pull-up part and the transfer part, a first power supply and a second power supply to pull down, according to a pull-down control signal, a potential of the gate signal output end and/or potentials of the control ends of the pull-up part and the transfer part to a potential of the first power supply or the second power supply, so as to turn off the gate signal output end and/or turn off the pull-up part and the transfer part; and a pull-down holding part, which is coupled among the gate signal output end, the control ends of the pull-up part and the transfer part, the first power supply and the second power supply to hold, according to a pull-down holding control signal, a potential of the gate signal output end and/or potentials of the control ends of the pull-up part and the transfer part at a potential of the first power supply or the second power supply;

wherein the key pull-down part and/or the pull-down holding part are further coupled between the output end of the transfer part and the second power supply, so as to pull the transfer signal down to and/or hold the transfer signal at a potential of the second power supply, the potential of the second power supply being lower than that of the first power supply;

wherein the pull-down holding part includes a first pull-down holding module and a second pull-down holding module which modules work in an alternate manner;

wherein each of the pull-down holding modules includes: a control sub-module, for outputting the pull-down holding control signal; and wherein the control sub-module includes: a first transistor, the gate of which is in short connection with its first end, and a second end of which is coupled with the output end of the control sub-module; a second transistor, a first end and a second end of which are coupled, respectively, with the first end of the first transistor and the output end of the control sub-module; a third transistor, the gate of which receives a transfer signal output by a $(N-1)^{th}$ gate driving unit, and a first end and a second end of which are coupled, respectively, with the output end of the control sub-module and to the second power supply; and a fourth transistor, the gate of which receives a transfer signal output by the $N^{th}$ gate driving unit, and a first end and a second end of which are coupled, respectively, with the output end of the control sub-module and to the second power supply; wherein the gate of the first transistor in the first pull-down holding module and the gate of the second transistor in the second pull-down holding module both receive a first control signal, and the gate of the second transistor in the first pull-down holding module and the gate of the first transistor in the second pull-down holding module both receive a second control signal, the first control signal and the second control signal being pulse signals of which the phases are complementary; or the control sub-module includes: a first transistor, the gate of which is in short connected with its first end, and a second end of which is coupled with the output end of the control sub-module; a second transistor, the gate of which is coupled with the output end of the control sub-module, and a first end and a second end of which are coupled, respectively, with the first end of the first transistor and the output end of the control sub-module; a third transistor, the gate of which receives a transfer signal output by a (N−1)th gate driving unit, and a first end and a second end of which are coupled, respectively, with the output end of the control sub-module and to the second power supply; and a fourth transistor, the gate of which receives a transfer signal output by the Nth gate driving unit, and a first end and a second end of which are coupled, respectively, with the output end of the control sub-module and to the second power supply; wherein the gate of the first transistor in the first pull-down holding module receives a first control signal, and the gate of the first transistor in the second pull-down holding module receives a second control signal, the first control signal and the second control signal being pulse signals of which the phases are complementary.

2. The gate driving circuit of claim 1, wherein the first power supply and the second power supply both are negative voltage sources.

3. The gate driving circuit of claim 1, wherein each of the pull-down holding modules further includes:

a first pull-down transistor, the gate of which is coupled with an output end of the control sub-module to receive the pull-down holding control signal, a first end of which is coupled with the gate signal output end, and a second end of which is coupled to the first power supply or the second power supply;

a second pull-down transistor, the gate of which is coupled with the output end of the control sub-module to receive the pull-down holding control signal, a first end of which is coupled with the output end of the pull-up control part, and a second end of which is coupled to the first power supply or the second power supply; and a third pull-down transistor, the gate of which is coupled with the output end of the control sub-module to receive the pull-down holding control signal, and a first end and a second end of which are coupled, respectively, with the output end of the transfer part and to the second power supply.

4. The gate driving circuit of claim 1, wherein the first control signal is the clock signal.

5. The gate driving circuit of claim 1, wherein the first control signal is a low-frequency pulse signal.

6. The gate driving circuit of claim 5, wherein when a $(N+2)^{th}$ gate driving unit outputs a gate signal of high level, the first control signal is overturned.

7. The gate driving circuit of claim 1, wherein the key pull-down part pulls down potential of the gate signal output end to a potential of the first power supply, and pulls down potentials of the control ends of the pull-up part and the transfer part to a potential of the second power supply; and the pull-down holding part holds the potential of the gate signal output end at the potential of the first power supply, and holds the potentials of the control ends of the pull-up part and the transfer part at the potential of the second power supply.

8. The gate driving circuit of claim 1, wherein the key pull-down part pulls down potential of the gate signal output end and potentials of the control ends of the pull-up part and the transfer part to a potential of the first power supply; and the pull-down holding part holds the potential of the gate signal output end and the potentials of the control ends of the pull-up part and the transfer part at the potential of the first power supply.

9. The gate driving circuit of claim 8, wherein the key pull-down part includes:

a first transistor, the gate of which receives a pull-down control signal, and a first end and a second end of which are coupled, respectively, with the output end of the pull-up control part and to the first power supply; and a second transistor, the gate of which receives the pull-down control signal, and a first end and a second end of which are coupled, respectively, with the gate signal output end and to the first power supply;

wherein the pull-down control signal is a gate signal output by a $(N-1)^{th}$ gate driving unit or by a $(N+2)^{th}$ gate driving unit.

10. The gate driving circuit of claim 8, wherein the key pull-down part includes:

a first transistor, the gate of which receives a pull-down control signal, and a first end and a second end of which are coupled, respectively, with the output end of the pull-up control part and to the first power supply;

wherein the pull-down control signal is a gate signal output by a $(N+2)^{th}$ gate driving unit.

11. The gate driving circuit of claim 8, wherein the key pull-down part includes:

a first transistor, the gate of which receives the pull-down control signal, and a first end and a second end of which are coupled, respectively, with the output end of the pull-up control part and to the first power supply;

a second transistor, the gate of which receives the pull-down control signal, and a first end and a second end of which are coupled, respectively, with the gate signal output end and to the first power supply; and a third transistor, the gate of which receives the pull-down control signal, and a first end and a second end of which are coupled, respectively, with the output end of the transfer part and to the second power supply;

wherein the pull-down control signal is a gate signal output by a $(N+1)^{th}$ gate driving unit.

12. The gate driving circuit of claim 8, wherein the key pull-down part includes:

a first transistor, the gate of which receives a first pull-down control signal, and a first end and a second end of which are coupled, respectively, with the output end of the pull-up control part and to the first power supply; and a second transistor, the gate of which receives a second pull-down control signal, and a first end and a second end of which are coupled, respectively, with the output end of the transfer part and to the second power supply;

wherein the first pull-down control signal is a gate signal output by a $(N+2)^{th}$ gate driving unit, and the second pull-down control signal is a gate signal output by a $(N+1)^{th}$ gate driving unit.

13. The gate driving circuit of claim 12, wherein the key pull-down part further includes a third transistor, wherein the gate thereof receives the second pull-down control signal, and a first end and a second end thereof are coupled, respectively, with the gate signal output end and to the first power supply.

14. The gate driving circuit of claim 9, wherein the key pull-down part further include a choking transistor, the gate of which is in short connection with its first end, and the first end and a second end of which are coupled, respectively, with the second end of the first transistor and to the second power supply.

15. The gate driving circuit of claim 10, wherein the key pull-down part further include a choking transistor, the gate of which is in short connection with its first end, and the first end and a second end of which are coupled, respectively, with the second end of the first transistor and to the second power supply.

16. The gate driving circuit of claim 13, wherein in the key pull-down part, a channel width of the choking transistor is set as 5~10 times of that of the first transistor.

17. The gate driving circuit of claim 1, wherein the pull-up control signal is a gate signal output by a $(N-1)^{th}$ gate driving unit.

* * * * *